US010290306B2

(12) United States Patent
Neuendorf et al.

(10) Patent No.: US 10,290,306 B2
(45) **Date of Patent: *May 14, 2019**

(54) FRAME ELEMENT POSITIONING IN FRAMES OF A BITSTREAM REPRESENTING AUDIO CONTENT

(71) Applicants: Fraunhofer-Gesellschaft zur Foerderung der angewandten Forschung e.V., Munich (DE); Dolby International AB, Amsterdam Zuid-Oost (NL); Koninklijke Philips N.V., Eindhoven (NL)

(72) Inventors: Max Neuendorf, Nuremberg (DE); Markus Multrus, Nuremberg (DE); Stefan Doehla, Erlangen (DE); Heiko Purnhagen, Sundbyberg (SE); Frans De Bont, Riethoven (NL)

(73) Assignees: FRAUNHOFER-GESELLSCHAFT ZUR FOERDERUNG DER ANGEWANDTEN FORSCHUNG E.V., Munich (DE); DOLBY INTERNATIONAL AB, Amsterdam (NL); KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/950,295

(22) Filed: Apr. 11, 2018

(65) Prior Publication Data

US 2018/0233155 A1 Aug. 16, 2018

Related U.S. Application Data

(63) Continuation of application No. 15/613,484, filed on Jun. 5, 2017, now Pat. No. 9,972,331, which is a (Continued)

(51) Int. Cl.
*G10L 19/00* (2013.01)
*G10L 19/008* (2013.01)

(Continued)

(52) U.S. Cl.
CPC ..... *G10L 19/008* (2013.01); *G10L 19/00* (2013.01); *G10L 19/167* (2013.01); *G10L 19/18* (2013.01)

(58) Field of Classification Search
USPC ..... 704/500–504
See application file for complete search history.

(56) References Cited

PUBLICATIONS

Neuendorf et al., "Frame Element Positioning in Frames of a Bitstream Representing Audio Content", U.S. Appl. No. 15/613,484, filed Jun. 5, 2017.

(Continued)

*Primary Examiner* — Leonard Saint Cyr
(74) *Attorney, Agent, or Firm* — Keating & Bennett, LLP

(57) ABSTRACT

A better compromise between a too high bitstream and decoding overhead on the one hand and flexibility of frame element positioning on the other hand is achieved by arranging that each of the sequence of frames of the bitstream has a sequence of N frame elements and, on the other hand, the bitstream has a configuration block having a field indicating the number of elements N and a type indication syntax portion indicating, for each element position of the sequence of N element positions, an element type out of a plurality of element types with, in the sequences of N frame elements of the frames, each frame element being of the element type indicated, by the type indication portion, for the respective element position at which the respective frame element is positioned within the sequence of N frame elements of the respective frame in the bitstream.

10 Claims, 34 Drawing Sheets

Related U.S. Application Data continuation of application No. 14/029,058, filed on Sep. 17, 2013, now Pat. No. 9,779,737, which is a continuation of application No. PCT/EP2012/054821, filed on Mar. 19, 2012.

(60) Provisional application No. 61/454,121, filed on Mar. 18, 2011.

(51) Int. Cl.
*G10L 19/16* (2013.01)
*G10L 19/18* (2013.01)

(56) References Cited

PUBLICATIONS

Max Neuendorf et al, "Follow-up on proposed revision of USAC bit stream syntax", 96. MPEG Meeting; Mar. 21, 2011-Mar. 25, 2011; Geneva; (Motion Picture Expert Group or ISO/IEC JTC1/SC29/WG11).

Max Neuendorf et al, "Proposed revision of USAC bit stream syntax addressing USAC design considerations", 95. MPEG Meeting; Jan. 24, 2011-Jan. 28, 2011; DAEGU; (Motion Picture Expert Group or ISO/IEC JTC1/SC29/WG11).

Syntax of UsacConfig()

| Syntax | No. of bits | Mnemonic |
|---|---|---|
| UsacConfig() | | |
| { | | |
| **usacSamplingFrequencyIndex;** | **5** | **bslbf** |
| if ( usacSamplingFrequecyIndex == 0x1f ) { | | |
| **usacSamplingFrequency;** | **24** | **uimsbf** |
| } | | |
| **coreSbrFrameLenghtIndex;** | **3** | **uimsbf** |
| **channelConfigurationIndex;** | **5** | **uimsbf** |
| if (channelConfigurationIndex ==0) { | | |
| UsacChannelConfig(); | | |
| } | | |
| UsacDecoderConfig(); | | |
| if (**usacConfigExtensionPresent**==1){ | **1** | **uimsbf** |
| UsacConfigExtension(); | | |
| } | | |
| } | | |

FIG 4A

Syntax of UsacChannelConfig()

| Syntax | No. of bits | Mnemonic |
|---|---|---|
| UsacChannelConfig() | | |
| { | | |
| numOutChannels = escapedValue(5,8,16); | | |
| for (i=0; i<numOutChannels; i++) { | | |
| **bsOutputChannelPos[i];** | **5** | **uimsbf** |
| } | | |
| } | | |

FIG 4B

Syntax of UsacDecoderConfig()

| Syntax | No. of bits | Mnemonic |
|---|---|---|
| UsacDecoderConfig() | | |
| { | | |
| numElements = escapedValue(4,8,16) + 1; | | |
| for (elemIdx=0; elemIdx<numElements; ++elemIdx) { | | |
| **usacElementType**[elemIdx] | **2** | **uimsbf** |
| switch (usacElementType[elemIdx]) { | | |
| case: ID_USAC_SCE | | |
| UsacSingleChannelElementConfig(sbrRatioIndex); | | |
| break; | | |
| case: ID_USAC_CPE | | |
| UsacChannelPairElementConfig(sbrRatioIndex); | | |
| break; | | |
| case: ID_USAC_LFE | | |
| UsacLfeElementConfig(); | | |
| break; | | |
| case: ID_USAC_EXT | | |
| UsacExtElementConfig(); | | |
| break; | | |
| } | | |
| } | | |

NOTE: UsacSingleChannelElementConfig(), UsacChannelPairElementConfig(), UsacLfeElement-Config() and UsacExtElementConfig() signaled at position elemIdx refer to the corresponding elements in UsacFrame() at the respective position elemIdx.

FIG 4C

Syntax of UsacSingleChannelElementConfig()

| Syntax | No. of bits | Mnemonic |
|---|---|---|
| UsacSingleChannelElementConfig(sbrRatioIndex) | | |
| { | | |
| UsacCoreConfig(); | | |
| if (sbrRatioIndex > 0) { | | |
| SbrConfig(); | | |
| } | | |
| } | | |

FIG 4D

Syntax of UsacChannelPairElementConfig()

| Syntax | No. of bits | Mnemonic |
|---|---|---|
| UsacChannelPairElementConfig(sbrRatioIndex) | | |
| { | | |
| UsacCoreConfig(); | | |
| if (sbrRatioIndex > 0) { | | |
| SbrConfig(); | | |
| **stereoConfigIndex;** | **2** | **uimsbf** |
| } | | |
| else { | | |
| stereoConfigIndex = 0; | | |
| } | | |
| if (stereoConfigIndex > 0) { | | |
| Mps212Config(stereoConfigIndex); | | |
| } | | |
| } | | |

FIG 4E

Syntax of UsacLfeElementConfig()

| Syntax | No. of bits | Mnemonic |
|---|---|---|
| UsacLfeElementConfig() | | |
| { | | |
| tw_mdct = 0; | | |
| noiseFilling = 0; | | |
| } | | |

FIG 4F

Syntax of UsacCoreConfig()

| Syntax | No. of bits | Mnemonic |
|---|---|---|
| UsacCoreConfig() | | |
| { | | |
| **tw_mdct;** | **1** | **bslbf** |
| **noiseFilling;** | **1** | **bsblf** |
| } | | |

FIG 4G

Syntax of SbrConfig()

| Syntax | No. of bits | Mnemonic |
|---|---|---|
| SbrConfig() | | |
| { | | |
| **harmonicsSBR;** | **1** | **bsblf** |
| **bs_interTes;** | **1** | **bsblf** |
| **bs_pvc;** | **1** | **bsblf** |
| SbrDfltHeader(); | | |
| } | | |

FIG 4H

Syntax of SbrDfltHeader()

| Syntax | No. of bits | Mnemonic |
|---|---|---|
| SbrDfltHeader() | | |
| { | | |
| dflt_start_freq; | 4 | uimsbf |
| dflt_stop_freq; | 4 | uimsbf |
| dflt_header_extra1; | 1 | uimsbf |
| dflt_header_extra2; | 1 | uimsbf |
| if (dflt_header_extra1 ==1) { | | |
| dflt_freq_scale; | 2 | uimsbf |
| dflt_alter_scale; | 1 | uimsbf |
| dflt_noise_bands; | 2 | uimsbf |
| } | | |
| if (dflt_header_extra2 ==1) { | | |
| dflt_limiter_bands; | 2 | uimsbf |
| dflt_limiter_gains; | 2 | uimsbf |
| dflt_interpol_freq; | 1 | uimsbf |
| dflt_smoothing_mode; | 1 | uimsbf |
| } | | |
| } | | |

FIG 4I

Syntax of Mps212Config()

| Syntax | No. of bits | Mnemonic |
|---|---|---|
| Mps212Config(stereoConfigIndex) | | |
| { | | |
| **bsFreqRes;** | 3 | uimsbf |
| **bsFixedGainDMX;** | 3 | uimsbf |
| **bsTempShapeConfig;** | 2 | uimsbf |
| **bsDecorrConfig;** | 2 | uimsbf |
| **bsHighRateMode;** | 1 | uimsbf |
| **bsPhaseCoding;** | 1 | uimsbf |
| **bsOttBandsPhasePresent;** | 1 | uimsbf |
| if (bsOttBandsPhasePresent) { | | NOTE 1 |
| **bsOttBandsPhase;** | 5 | uimsbf |
| } | | |
| if (bsResidualCoding) { | | NOTE 2 |
| **bsResidualBands;** | 5 | uimsbf |
| bsOttBandsPhase = max(bsOttBandsPhase,bsResidualBands); | | |
| **bsPseudoLr;** | 1 | uimsbf |
| } | | |
| if (bsTempShapeConfig == 2) { | | |
| **bsEnvQuantMode;** | 1 | uimsbf |
| } | | |
| } | | |

NOTE 1: if bsOttBandsPhasePresent==0 bsOttBandsPhase ist initialized according to Table 104.
NOTE 2: bsResidualCoding depends on stereoConfigIndex according to Table 72.

FIG 4J

Syntax of UsacExtElementConfig()

| Syntax | No. of bits | Mnemonic |
|---|---|---|
| UsacExtElementConfig() | | |
| { | | |
| usacExtElementType = escapedValue(4,8,16); | | |
| usacExtElementConfigLenght = escapedValue(4,8,16); | | |
| **usacExtElementDefaultLenghtPresent;** | **1** | **uimsbf** |
| if (usacExtElementDefaultLenghtPresent) { | | |
| usacExtElementDefaultLenght = escapedValue(8,16,0) +1; | | |
| } else { | | |
| usacExtElementDefaultLenght = 0; | | |
| } | | |
| **usacExtElementPayloadFrag;** | **1** | **uimsbf** |
| switch (usacExtElementType) { | | |
| case ID_EXT_ELE_FILL: | | |
| break; | | |
| case ID_EXT_ELE_MPEGS: | | |
| SpatialSpecificConfig(); | | |
| break; | | |
| case ID_EXT_ELE_SAOC: | | |
| SaocSpecificConfig(); | | |
| break; | | |
| default: | NOTE | |
| while (usacExtElementConfigLenght--) { | | |
| **tmp;** | **8** | **uimsbf** |
| } | | |
| break; | | |
| } | | |
| } | | |

NOTE: The default entry for the usacExtElementType is used for unknown extElementTypes so that legacy decoders can cope with future extensions.

FIG 4K

Syntax of UsacConfigExtension()

| Syntax | No. of bits | Mnemonic |
|---|---|---|
| UsacConfigExtension() | | |
| { | | |
| numConfigExtensions = escapedValue(2,4,8) + 1; | | |
| for (confExtIdx=0; confExtIdx<numConfigExtensions; confExtIdx++) { | | |
| usacConfigExtType[confExtIdx] = escapedValue(4,8,16); | | |
| usacConfigExtLenght[confExtIdx] = escapedValue(4,8,16); | | |
| switch (usacConfigExtType[confExtIdx]) { | | |
| case ID_CONFIG_EXT_FILL: | | |
| while (usacConfigExtLenght[confExtIdx]--) { | | |
| **fill_byte[i];** /* should be '10100101' */ | **8** | **uimsbf** |
| } | | |
| break; | | |
| default: | | |
| while (usacConfigExtLenght[confExtIdx]--) { | | |
| **tmp;** | **8** | **uimsbf** |
| } | | |
| break; | | |
| } | | |
| } | | |
| } | | |

FIG 4L

Syntax of escapedValue()

| Syntax | No. of bits | Mnemonic |
|---|---|---|
| escapedValue(nBits1, nBits2, nBits3) | | |
| { | | |
| **value;** | **nBits1** | **uimsbf** |
| if (value ==$2^{nBits1}$ -1) { | | |
| value += **valueAdd;** | **nBits2** | **uimsbf** |
| if (valueAdd ==$2^{nBits2}$ -1) { | | |
| value += **valueAdd;** | **nBits3** | **uimsbf** |
| } | | |
| } | | |
| return value; | | |
| } | | |

FIG 4M

Syntax of UsacFrame()
top level payload for radio object type USAC

| Syntax | No. of bits | Mnemonic |
|---|---|---|
| UsacFrame() | | |
| { | | |
| **usacIndependencyFlag;** | **1** | **uimsbf** |
| for (elemIdx=0; elemIdx<numElements; ++elemIdx) { | | |
| switch (usacElementType[elemIdx]) { | | |
| case: ID_USAC_SCE | | |
| UsacSingleChannelElement(usacIndependencyFlag); | | |
| break; | | |
| case: ID_USAC_CPE | | |
| UsacChannelPairElement(usacIndependencyFlag); | | |
| break; | | |
| case: ID_USAC_LFE | | |
| UsacLfeElement(usacIndependencyFlag); | | |
| break; | | |
| case: ID_USAC_EXT | | |
| UsacExtElement(usacIndependencyFlag); | | |
| break; | | |
| } | | |
| } | | |

FIG 4N

Syntax of UsacSingleChannelElement()

| Syntax | No. of bits | Mnemonic |
|---|---|---|
| UsacSingle ChannelElement(indepFlag) | | |
| { | | |
| UsacCoreCoderData(1. indepFlag); | | |
| | | |
| if (sbrRatioIndex > 0) { | | |
| UsacSbrData(1. indepFlag); | | |
| } | | |
| } | | |

FIG 40

Syntax of UsacChannelPairElement()

| Syntax | No. of bits | Mnemonic |
|---|---|---|
| UsacChannelPairElement(indepFlag) | | |
| { | | |
| if (stereoConfigIndex == 1) { | | |
| nrCoreCoderChannels = 1; | | |
| } else { | | |
| nrCoreCoderChannels = 2; | | |
| } | | |
| UsacCoreCoderData(nrCoreCoderChannels, indepFlag); | | |
| if (sbrRatioIndex > 0) { | | |
| if (stereoConfigIndex == 0 \|\| stereoConfigIndex == 3) { | | |
| nrSbrChannels = 2; | | |
| } else { | | |
| nrSbrChannels = 1; | | |
| } | | |
| UsacSbrData(nrSbrChannels, indepFlag); | | |
| } | | |
| if (stereoConfigIndex > 0) { | | |
| Mps212Data(indepFlag); | | |
| } | | |
| } | | |

FIG 4P

Syntax of UsacLfeElement()

| Syntax | No. of bits | Mnemonic |
|---|---|---|
| UsacLfeElement(indepFlag) | | |
| { | | |
| fd_channel_stream(0,0,0,0 indepFlag); | | |
| } | | |

FIG 4Q

Syntax of UsacExtElement()

| Syntax | No. of bits | Mnemonic |
|---|---|---|
| UsacExtElement(indepFlag) | | |
| { | | |
| **usacExtElementPresent** | **1** | **uimsbf** |
| if (usacExtElementPresent==1) { | | |
| **usacExtElementUseDefaultLenght;** | **1** | **uimsbf** |
| if (usacExtElementUseDefaultLenght) { | | |
| usacExtElementPayloadLenght = usacExtElementDefaultLenght; | | |
| } else { | | |
| usacExtElementPayloadLenght = escapedValue(8,16,0); | | |
| } | | |
| if (usacExtElementPayloadLenght>0) { | | |
| if (usacExtElementPayloadFrag) { | | |
| **usacExtElementStart;** | **1** | **uimsbf** |
| **usacExtElementStop;** | **1** | **uimsbf** |
| } else { | | |
| (usacExtElementStart = 1; | | |
| (usacExtElementStop = 1; | | |
| } | | |
| for (i=0; I<usacExtElementPayloadLenght; i++) { | | |
| **usacExtElementSegmentData[i]** | **8** | **uimsbf** |
| } | | |
| } | | |
| } | | |
| } | | |

FIG 4R

Syntax of UsacCoreCoderData()

| Syntax | No. of bits | Mnemonic |
|---|---|---|
| UsacCoreCoderData(nrChannels. indepFlag) | | |
| { | | |
| for (ch=0; ch < nrChannels; ch++) { | | **uimsbf** |
| **core_mode[ch];** | **1** | |
| } | | |
| if (nrChannels == 2) { | | |
| StereoCoreToolInfo(core_mode); | | |
| } | | |
| for (ch=0; ch < nrChannels; ch++) { | | |
| if (core_mode[ch] == 1){ | | |
| lpd_channel_stream(indepFlag); | | |
| } | | |
| else { | | |
| if ( (nrChannels == 1) \|\| (core_model[0] !=core_model[1]) ) { | | |
| **tns_data_present[ch];** | **1** | **uimsbf** |
| } | | |
| fd_channel_stream(common_window, common_tw, tns_data_present[ch], noiseFilling, indepFlag); | | |
| } | | |
| } | | |
| } | | |

FIG 4S

Syntax of StereoCoreToolInfo()

| Syntax | No. of bits | Mnemonic |
|---|---|---|
| StereoCoreToolInfo(core_mode) | | |
| { | | |
| if (core_mode[0] == 0 && core_model[1] == 0) { | | |
| **tns_active;** | 1 | uimsbf |
| **common_window) {** | 1 | uimsbf |
| if (common_window) { | | |
| ics_info(); | | |
| **common_max_sfb;** | 1 | uimsbf |
| if (common_max_sfb == 0) { | | |
| if (window_sequence == EIGHT_SHORT_SEQUENCE) { | | |
| **max_sfb 1;** | 4 | uimsbf |
| } else { | | |
| **max_sfb 1;** | 6 | uimsbf |
| } | | |
| } else { | | |
| max_sfb 1 = max_sfb; | | |
| } | | |
| max_sfb_ste = max(max_sfb. max_sfb1); | | |
| **ms_mask_present;** | 2 | uimsbf |
| if ( ms_mask_present == 1 ) { | | |
| for (g = 0; g < num_window_groups; g++) { | | |
| for (sfb = 0; sfb < max_sfb; sfb++) { | | |
| **ms_used[g][sfb];** | 1 | uimsbf |
| } | | |
| } | | |
| } | | |

| FIG 4T | FIG 4T-1 |
|---|---|
| | FIG 4T-2 |
| | FIG 4T-3 |

FIG 4T-1

```
        if (ms_mask_present == 3) {
            cplx_pred_data();
        } else {
            alpha_q_re[g][sfb] = 0;
            alpha_q_im[g][sfb] = 0;
        }
    }
    if (tw_mdct) {
        common_tw;                                  1     uimsbf
        if ( common_tw ) {
            tw_data();
        }
    }
    if (tns_active) {
        if (common_window) {
            common_tns;                             1     uimsbf
        } else {
            common_tns = 0;
        }
        tns_on_lr                                   1     uimsbf
        if (common_tns) {
            tns_data();
            tns_data_present[0] = 0;
            tns_data_present[1] = 0;
```

| FIG 4T | FIG 4T-1 |
|---|---|
| | FIG 4T-2 |
| | FIG 4T-3 |

FIG 4T-2

```
            } else {
                tns_present_both;                          1    uimsbf
                if (tns_present_both) {
                    tns_data_present[0] = 1;
                    tns_data_present[1] = 1;
                } else {
                    tns_data_present[1];                   1    uimsbf
                    tns_data_present[0] = 1 - tns_data_present[1];
                }
            }
        } else {
            common_tns = 0;
            tns_data_present[0] = 0;
            tns_data_present[1] = 0;
        }
    } else {
        common_window = 0;
        common_tw = 0;
    }
}
```

| FIG 4T | FIG 4T-1 |
|---|---|
| | FIG 4T-2 |
| | FIG 4T-3 |

FIG 4T-3

Syntax of fd_channel_stream()

| Syntax | No. of bits | Mnemonic |
|---|---|---|
| fd_channel_stream(common_window, common_tw, tns_data_present, noiseFilling, indepFlag) | | |
| { | | |
| **global_gain;** | **8** | **uimsbf** |
| if (noiseFilling) { | | |
| **noise_level;** | **3** | **uimsbf** |
| **noise_offset;** | **5** | **uimsbf** |
| } | | |
| else { | | |
| noise_level = 0; | | |
| } | | |
| if (!common_window) { | | |
| ics_info(); | | |
| } | | |
| if (tw_mdct) { | | |
| if (!common_tw) { | | |
| tw_data (); | | |
| } | | |
| } | | |
| scala_factor_data (); | | |
| if (tns_data_present) { | **1** | **uimsbf** |
| tns_data (); | | |
| { | | |
| ac_spectral_data( indepFlag); | | |
| **fac_data_present;** | | |
| if (fac_data_present) { | | |
| fac_length = (window_sequence==EIGHT_SHORT_SEQUENCE) ? ccfl/16 : ccfl/8; | | |
| fac_data(1, fac_length), | | |
| } | | |
| } | | |

FIG 4U

Syntax of lpd_channel_stream()

| Syntax | No. of bits | Mnemonic |
|---|---|---|
| lpd_channel_stream(indepFlag) | | |
| { | | |
| **acelp_core_mode;** | **3** | **uimsbf** |
| **lpd_mode;** | **5** | **uimsbf,** NOTE 1 |
| **bpf_control_info;** | **1** | **uimsbf** |
| **core_mode_last;** | **1** | **uimsbf** |
| **fac_data_present;** | **1** | **uimsbf** |
| first_lpd_flag = !core_mode_lst; | | |
| first_tcx_flag=TRUE; | | |
| k = 0; | | |
| if (first_lpd_flag) { last_lpd_mode = -1; } | | NOTE 2 |
| while (k < 4) { | | |
| if (k==0){ | | |
| if ( (core_mode_last==1) && (fac_data_present==1) ) { | | |
| fac_data(0, ccfl/8); | | |
| } | | |
| } else { | | |
| if ( (last_lpd_mode==0 && mod[k]>0) \|\| (last_lpd_mode>0 && mod[k]==0) ) { | | |
| fac_data(0, ccfl/8); | | |
| } | | |
| } | | |

FIG 4V
FIG 4V-1
FIG 4V-2

FIG 4V-1

```
        if (mod[k] == 0) {
            acelp_coding(acelp_core_mode);
            last_lpd_mode=0;
            k += 1;
        }
        else {
            tcx_coding( lg(mod[k]) , first_tcx_flag, indepFlag);          NOTE 3
            last_lpd_mode=mod[k];
            k += ( 1 << (mod[k]-1) );
            first_tcx_flag=FALSE;
        }
    }

    lpc_data(first_lpd_flag);

    if ( (core_mode_last==0) && (fac_data_present==1) ) {
        short_fac_flag;                                   1      uimsbf
        fac_lenth = short_fac_flag ? ccfl/16 : ccfl/8;
        fac_data(1. fac_lenth);

    }
}
```

NOTE 1: lpd_mode defines the contents of the array mod[] as described in 6.2.10.2, Table 89.
NOTE 2: first_lpd_flg is defined in2: 6.2.10.2.
NOTE 3: The number of spectral coefficients. lg, depends on mod[k] according to Table 148.

| FIG 4V | FIG 4V-1 |
|---|---|
| | FIG 4V-2 |

FIG 4V-2

Syntax of fac_data()

| Syntax | No. of bits | Mnemonic |
|---|---|---|
| fac_data(useGain, fac_length) | | |
| { | | |
| if (useGain) { | | |
| **fac_gain;** | **7** | **uimsbf** |
| } | | |
| for (i=0; i<fac_length/8; i++) { | | |
| code_book_indices (i, 1, 1); | | |
| } | | |
| } | | |

NOTE 1: This value is encoded using a modified unary code, where qn=0 is represented by one "0" bit, and any value qn greater or equal to 2 is represented by qn-1 "1" bits followed by one "0" stop bit.
Note that qn=1 cannot be signaled, because the codebook $Q_1$ is not defined.

FIG 4W

Syntax of UsacSbrData()

| Syntax | No. of bits | Mnemonic |
|---|---|---|
| UsacSbrData(numberSbrChannels, indepFlag) | | |
| { | | |
| if (indepFlag) { | | |
| sbrInfoPresent = 1; | | |
| sbrHeaderPresent = 1; | | |
| } else { | | |
| **sbrInfoPresent;** | **1** | **uimsbf** |
| if (sbrInfoPresent) { | | |
| **sbrHeaderPresent;** | **1** | **uimsbf** |
| } else { | | |
| sbrHeaderPresent = 0; | | |
| } | | |
| } | | |
| if /sbrInfoPresent) { | | |
| SbrInfo(); | | |
| } | | |
| if (sbrHeaderPresent) { | | |
| **sbrUseDfltHeader;** | **1** | **uimsbf** |
| if (sbrUseDfltHeader) { | | |
| /* copy all SbrDfltHeader() elements | | |
| dlft_xxx_yyy to bs_xxx_yyy */ | | |
| } else { | | |
| SbrHeader(); | | |
| } | | |
| } | | |
| sbr_data(bs_amp_res, nimberSbrChannels, indepFlag); | | |
| } | | |

FIG 4X

Syntax of SbrInfo()

| Syntax | No. of bits | Mnemonic |
|---|---|---|
| SbrInfo() | | |
| { | | |
| bs_amp_res; | 1 | uimsbf |
| bs_xover_band; | 4 | uimsbf |
| bs_sbr_preprocessing; | 1 | uimsbf |
| if (bs_pvc) { | | |
| bs_pvc_mode; | 2 | uimsbf |
| } | | |
| } | | |

FIG 4Y

Syntax of SbrHeader()

| Syntax | No. of bits | Mnemonic |
|---|---|---|
| SbrHeader() | | |
| { | | |
| bs_start_freq; | 4 | uimsbf, NOTE 1 |
| bs_stop_freq; | 4 | uimsbf, NOTE 1 |
| bs_header_extra_1; | 1 | uimsbf |
| bs_header_extra_2; | 1 | uimsbf |
| if (bs_header_extra_1) { | | NOTE 2 |
| bs_freq_scale; | 2 | uimsbf |
| bs_alter_scale; | 1 | uimsbf |
| bs_noise_bands; | 2 | uimsbf |
| } | | |
| if (bs_header_extra_2) { | | NOTE 2 |
| bs_limiter_bands; | 2 | uimsbf |
| bs_limiter_gains; | 2 | uimsbf |
| bs_interpol_freq; | 1 | uimsbf |
| bs_smoothing_mode; | 1 | uimsbf |
| } | | |
| } | | |

NOTE 1: bs_start_freq and bs_stop_freq shall define a frequency band that does not exceed the limits defined in 7.5.5 and ISO/IEC 14496-3:2009, 4.6.18.3.6.
NOTE 2: If this bit is not set the default values for the underlying data elements shall be used disregarded any previous value.

FIG 4Z

Syntax of sbr_data()

| Syntax | No. of bits | Mnemonic |
|---|---|---|
| sbr_data(bs_amp_res, numberSbrChannels, indepFlag) | | |
| { | | |
| switch (numberSbrChannels) { | | |
| case 1: | | |
| sbr_single_channel_element(bs_amp_res, bs_pvc_mode, indepFlag); | | |
| break; | | |
| case 2: | | |
| sbr_channel_pair_element(bs_amp_res, indepFlag); | | |
| break; | | |
| } | | |
| } | | |

FIG 4ZA

Syntax of ssbr_envelope()

| Syntax | No. of bits | Mnemonic |
|---|---|---|
| sbr_envelope(ch. bs_coupling, bs_amp_res) | | |
| { | | |
| if (bs_coupling) { | | |
| if (ch) { | | |
| if (bs_amp_res) { | | |
| t_huff = t_huffman_env_bal_3_0dB; | | |
| f_huff = f_huffman_env_bal_3_0dB; | | |
| } else { | | |
| t_huff = t_huffman_env_bal_1_5dB; | | |
| f_huff = f_huffman_env_bal_1_5dB; | | |
| } | | |
| } else { | | |
| if (bs_amp_res) { | | |
| t_huff = t_huffman_env_3_0dB; | | |
| f_huff = f_huffman_env_3_0dB; | | |
| } else { | | |
| t_huff = t_huffman_env_1_5dB; | | |
| f_huff = f_huffman_env_1_5dB; | | |
| } | | |
| } | | |
| } else { | | |
| if (bs_amp_res) { | | |
| t_huff = t_huffman_env_3_0dB; | | |
| f_huff = f_huffman_env_3_0dB; | | |
| } else { | | |
| t_huff = t_huffman_env_1_5dB; | | |
| f_huff = f_huffman_env_1_5dB; | | |
| } | | |
| } | | |

FIG 4ZB
FIG 4ZB-1
FIG 4ZB-2

FIG 4ZB-1

```
for (env = 0; env < bs_num_env[ch]: env++) {
    if (bs_df_env[ch][env] == 0) {
        if (bs_coupling && ch) {
            if (bs_amp_res)
                bs_data_env[ch][env][0] = bs_env_start_value_balance;      5     uimsbf
            else
                bs_data_env[ch][env][0] = bs_env_start_value_balance;      6     uimsbf
        } else {
            if (bs_amp_res)
                bs_data_env[ch][env][0] = bs_env_start_value_level;        6     uimsbf
            else
                bs_data_env[ch][env][0] = bs_env_start_value_level;        7     uimsbf
        }
        for (band = 1:.band < num_env_bands[bs_freq_res[ch][env]]: band++)          NOTE 1
            bs_data_env[ch][env][band] = sbr_huff_dec(f_huff, bs_codeword);   1..18  NOTE 2
    } else {
        for (band = 0: band < num_env_bands[bs_freq_res[ch][env]]: band++)          NOTE 1
            bs_data_env[ch][env][band] = sbr_huff_dec(t_huff, bs_codeword);   1..18  NOTE 2
    }
    if (bs_interTes) {
        bs_temp_shape[ch][env];                                            1     uimsbf
        If (bs_temp_shape[ch][env]) {
            bs_inter_temp_shape_mode[ch][env];                             2     uimsbf
        }
    }
}
}
```

NOTE 1: num_env_bands[bs_freq_res[ch][env]] is derived from the header according to ISO/IEC 14496-3:2009, 4.6.18.3 and is named n.
NOTE 2: sbr_huff_dec() is defined in ISO/IEC 14496-3:2009, 4.A.6.1.

| FIG 4ZB | FIG 4ZB-1 |
|---|---|
| | FIG 4ZB-2 |

FIG 4ZB-2

Syntax of FramingInfo()

| Syntax | No. of bits | Mnemonic |
|---|---|---|
| FramingInfo() | | |
| { | | |
| if (bsHighRateMode) { | | |
| **bsFramingType;** | **1** | **uimsbf** |
| **bsNumParamSets;** | **3** | **uimsbf** |
| } else { | | |
| bsFramingType = 0; | | |
| bsNumParamSets = 1; | | |
| } | | |
| numParamSets = bsNumParamSets + 1; | | |
| nBitsParamSlot = ceil(log2(numSlots)); | | |
| | | |
| if (bsFramingType) { | | |
| for (ps=0; ps<numParamSets; ps++) { | | |
| **bsParamSlot[ps];** | **nBitsParamSlot** | **uimsbf** |
| } | | |
| } | | |
| } | | |

FIG 4ZC

Block Diagram of the USAC encoder

Block Diagram of the USAC decoder

FRAME ELEMENT POSITIONING IN FRAMES OF A BITSTREAM REPRESENTING AUDIO CONTENT

CROSS-REFERENCE TO RELATED APPLICATIONS

This application is a continuation of copending International Application No. PCT/EP2012/054821, filed Mar. 19, 2012, which is incorporated herein by reference in its entirety, and additionally claims priority from U.S. Application No. 61/454,121, filed Mar. 18, 2011, which is also incorporated herein by reference in its entirety.

The present invention relates to audio coding, such as the so-called USAC codec (USAC=Unified Speech and Audio Coding) and, in particular, the frame element positioning within frames of respective bitstreams.

BACKGROUND OF THE INVENTION

In recent years, several audio codecs have been made available, each audio codec being specifically designed to fit to a dedicated application. Mostly, these audio codecs are able to code more than one audio channel or audio signal in parallel. Some audio codecs are even suitable for differently coding audio content by differently grouping audio channels or audio objects of the audio content and subjecting these groups to different audio coding principles. Even further, some of these audio codecs allow for the insertion of extension data into the bitstream so as to accommodate for future extensions/developments of the audio codec.

One example of such audio codecs is the USAC codec as defined in ISO/IEC CD 23003-3. This standard, named "Information Technology—MPEG Audio Technologies—Part 3: Unified Speech and Audio Coding", describes in detail the functional blocks of a reference model of a call for proposals on unified speech and audio coding.

FIGS. 5*a* and 5*b* illustrate encoder and decoder block diagrams. In the following, the general functionality of the individual blocks is briefly explained. Thereupon, the problems in putting all of the resulting syntax portions together into a bitstream is explained with respect to FIG. 6.

FIGS. 5*a* and 5*b* illustrate encoder and decoder block diagrams. The block diagrams of the USAC encoder and decoder reflect the structure of MPEG-D USAC coding. The general structure can be described like this: First there is a common pre/post-processing consisting of an MPEG Surround (MPEGS) functional unit to handle stereo or multichannel processing and an enhanced SBR (eSBR) unit which handles the parametric representation of the higher audio frequencies in the input signal. Then there are two branches, one consisting of a modified Advanced Audio Coding (AAC) tool path and the other consisting of a linear prediction coding (LP or LPC domain) based path, which in turn features either a frequency domain representation or a time domain representation of the LPC residual. All transmitted spectra for both, AAC and LPC, are represented in MDCT domain following quantization and arithmetic coding. The time domain representation uses an ACELP excitation coding scheme.

The basic structure of the MPEG-D USAC is shown in FIG. 5*a* and FIG. 5*b*. The data flow in this diagram is from left to right, top to bottom. The functions of the decoder are to find the description of the quantized audio spectra or time domain representation in the bitstream payload and decode the quantized values and other reconstruction information.

In case of transmitted spectral information the decoder shall reconstruct the quantized spectra, process the reconstructed spectra through whatever tools are active in the bitstream payload in order to arrive at the actual signal spectra as described by the input bitstream payload, and finally convert the frequency domain spectra to the time domain. Following the initial reconstruction and scaling of the spectrum reconstruction, there are optional tools that modify one or more of the spectra in order to provide more efficient coding.

In case of transmitted time domain signal representation, the decoder shall reconstruct the quantized time signal, process the reconstructed time signal through whatever tools are active in the bitstream payload in order to arrive at the actual time domain signal as described by the input bitstream payload.

For each of the optional tools that operate on the signal data, the option to "pass through" is retained, and in all cases where the processing is omitted, the spectra or time samples at its input are passed directly through the tool without modification.

In places where the bitstream changes its signal representation from time domain to frequency domain representation or from LP domain to non-LP domain or vice versa, the decoder shall facilitate the transition from one domain to the other by means of an appropriate transition overlap-add windowing.

eSBR and MPEGS processing is applied in the same manner to both coding paths after transition handling.

The input to the bitstream payload demultiplexer tool is the MPEG-D USAC bitstream payload. The demultiplexer separates the bitstream payload into the parts for each tool, and provides each of the tools with the bitstream payload information related to that tool.

The outputs from the bitstream payload demultiplexer tool are:

- Depending on the core coding type in the current frame either:
  - the quantized and noiselessly coded spectra represented by
  - scale factor information
  - arithmetically coded spectral lines
- or: linear prediction (LP) parameters together with an excitation signal represented by either:
  - quantized and arithmetically coded spectral lines (transform coded excitation, TCX) or
  - ACELP coded time domain excitation
- The spectral noise filling information (optional)
- The M/S decision information (optional)
- The temporal noise shaping (TNS) information (optional)
- The filterbank control information
- The time unwarping (TW) control information (optional)
- The enhanced spectral bandwidth replication (eSBR) control information (optional)
- The MPEG Surround (MPEGS) control information The scale factor noiseless decoding tool takes information from the bitstream payload demultiplexer, parses that information, and decodes the Huffman and DPCM coded scale factors.

The input to the scale factor noiseless decoding tool is:

- The scale factor information for the noiselessly coded spectra

The output of the scale factor noiseless decoding tool is:

- The decoded integer representation of the scale factors:

The spectral noiseless decoding tool takes information from the bitstream payload demultiplexer, parses that information, decodes the arithmetically coded data, and reconstructs the quantized spectra. The input to this noiseless decoding tool is:

The noiselessly coded spectra

The output of this noiseless decoding tool is:

The quantized values of the spectra

The inverse quantizer tool takes the quantized values for the spectra, and converts the integer values to the non-scaled, reconstructed spectra. This quantizer is a companding quantizer, whose companding factor depends on the chosen core coding mode.

The input to the Inverse Quantizer tool is:

The quantized values for the spectra

The output of the inverse quantizer tool is:

The un-scaled, inversely quantized spectra

The noise filling tool is used to fill spectral gaps in the decoded spectra, which occur when spectral value are quantized to zero e.g. due to a strong restriction on bit demand in the encoder. The use of the noise filling tool is optional.

The inputs to the noise filling tool are:

The un-scaled, inversely quantized spectra

Noise filling parameters

The decoded integer representation of the scale factors

The outputs to the noise filling tool are:

The un-scaled, inversely quantized spectral values for spectral lines which were previously quantized to zero.

Modified integer representation of the scale factors

The rescaling tool converts the integer representation of the scale factors to the actual values, and multiplies the un-scaled inversely quantized spectra by the relevant scale factors.

The inputs to the scale factors tool are:

The decoded integer representation of the scale factors

The un-scaled, inversely quantized spectra

The output from the scale factors tool is:

The scaled, inversely quantized spectra

For an overview over the M/S tool, please refer to ISO/IEC 14496-3:2009, 4.1.1.2.

For an overview over the temporal noise shaping (TNS) tool, please refer to ISO/IEC 14496-3:2009, 4.1.1.2.

The filterbank/block switching tool applies the inverse of the frequency mapping that was carried out in the encoder. An inverse modified discrete cosine transform (IMDCT) is used for the filterbank tool. The IMDCT can be configured to support 120, 128, 240, 256, 480, 512, 960 or 1024 spectral coefficients.

The inputs to the filterbank tool are:

The (inversely quantized) spectra

The filterbank control information

The output(s) from the filterbank tool is (are):

The time domain reconstructed audio signal(s).

The time-warped filterbank/block switching tool replaces the normal filterbank/block switching tool when the time warping mode is enabled. The filterbank is the same (IMDCT) as for the normal filterbank, additionally the windowed time domain samples are mapped from the warped time domain to the linear time domain by time-varying resampling.

The inputs to the time-warped filterbank tools are:

The inversely quantized spectra

The filterbank control information

The time-warping control information

The output(s) from the filterbank tool is (are):

The linear time domain reconstructed audio signal(s).

The enhanced SBR (eSBR) tool regenerates the highband of the audio signal. It is based on replication of the sequences of harmonics, truncated during encoding. It adjusts the spectral envelope of the generated highband and applies inverse filtering, and adds noise and sinusoidal components in order to recreate the spectral characteristics of the original signal.

The input to the eSBR tool is:

The quantized envelope data

Misc. control data a time domain signal from the frequency domain core decoder or the ACELP/TCX core decoder The output of the eSBR tool is either:

a time domain signal or a QMF-domain representation of a signal, e.g. in the MPEG Surround tool is used.

The MPEG Surround (MPEGS) tool produces multiple signals from one or more input signals by applying a sophisticated upmix procedure to the input signal(s) controlled by appropriate spatial parameters. In the USAC context MPEGS is used for coding a multi-channel signal, by transmitting parametric side information alongside a transmitted downmixed signal.

The input to the MPEGS tool is:

a downmixed time domain signal or a QMF-domain representation of a downmixed signal from the eSBR tool The output of the MPEGS tool is:

a multi-channel time domain signal

The Signal Classifier tool analyses the original input signal and generates from it control information which triggers the selection of the different coding modes. The analysis of the input signal is implementation dependent and will try to choose the optimal core coding mode for a given input signal frame. The output of the signal classifier can (optionally) also be used to influence the behavior of other tools, for example MPEG Surround, enhanced SBR, time-warped filterbank and others.

The input to the signal Classifier tool is:

the original unmodified input signal additional implementation dependent parameters The output of the Signal Classifier tool is:

a control signal to control the selection of the core codec (non-LP filtered frequency domain coding, LP filtered frequency domain or LP filtered time domain coding)

The ACELP tool provides a way to efficiently represent a time domain excitation signal by combining a long term predictor (adaptive codeword) with a pulse-like sequence (innovation codeword). The reconstructed excitation is sent through an LP synthesis filter to form a time domain signal.

The input to the ACELP tool is:

adaptive and innovation codebook indices adaptive and innovation codes gain values other control data inversely quantized and interpolated LPC filter coefficients The output of the ACELP tool is:

The time domain reconstructed audio signal

The MDCT based TCX decoding tool is used to turn the weighted LP residual representation from an MDCT-domain back into a time domain signal and outputs a time domain signal including weighted LP synthesis filtering. The IMDCT can be configured to support 256, 512, or 1024 spectral coefficients.

The input to the TCX tool is:

The (inversely quantized) MDCT spectra inversely quantized and interpolated LPC filter coefficients The output of the TCX tool is:

The time domain reconstructed audio signal

The technology disclosed in ISO/IEC CD 23003-3, which is incorporated herein by reference allows the definition of channel elements which are, for example, single channel elements only containing payload for a single channel or channel pair elements comprising payload for two channels or LFE (Low-Frequency Enhancement) channel elements comprising payload for an LFE channel.

Naturally, the USAC codec is not the only codec which is able to code and transfer information on a more complicated audio codec of more than one or two audio channels or audio objects via one bitstream. Accordingly, the USAC codec merely served as a concrete example.

FIG. 6 shows a more general example of an encoder and decoder, respectively, both depicted in one common scenery where the encoder encodes audio content 10 into a bitstream 12, with the decoder decoding the audio content or at least a portion thereof, from the bitstream 12. The result of the decoding, i.e. the reconstruction, is indicated at 14. As illustrated in FIG. 6, the audio content 10 may be composed of a number of audio signals 16. For example, the audio content 10 may be a spatial audio scene composed of a number of audio channels 16. Alternatively, the audio content 10 may represent a conglomeration of audio signals 16 with the audio signals 16 representing, individually and/or in groups, individual audio objects which may be put together into an audio scene at the discretion of a decoder's user so as to obtain the reconstruction 14 of the audio content 10 in the form of, for example, a spatial audio scene for a specific loudspeaker configuration. The encoder encodes the audio content 10 in units of consecutive time periods. Such a time period is exemplarily shown at 18 in FIG. 6. The encoder encodes the consecutive periods 18 of the audio content 10 using the same manner—that is, the encoder inserts into the bitstream 12 one frame 20 per time period 18. In doing so, the encoder decomposes the audio content within the respective time period 18 into frame elements, the number and the meaning/type of which is the same for each time period 18 and frame 20, respectively. With respect to the USAC codec outlined above, for example, the encoder encodes the same pair of audio signals 16 in every time period 18 into a channel pair element of the elements 22 of the frames 20, while using another coding principle, such as single channel encoding for another audio signal 16 so as to obtain a single channel element 22 and so forth. Parametric side information for obtaining an upmix of audio signals out of a downmix audio signal as defined by one or more frame elements 22 is collected to form another frame element within frame 20. In that case, the frame element conveying this side information relates to, or forms a kind of extension data for, other frame elements. Naturally, such extensions are not restricted to multi-channel or multi-object side information.

One possibility is to indicate within each frame element 22 of what type the respective frame element is. Advantageously, such a procedure allows for coping with future extensions of the bitstream syntax. Decoders which are not able to deal with certain frame element types, would simply skip the respective frame elements within the bitstream by exploiting respective length information within these frame elements. Moreover, it is possible to allow for standard conform decoders of different type: some are able to understand a first set of types, while others understand and can deal with another set of types; alternative element types would simply be disregarded by the respective decoders. Additionally, the encoder would be able to sort the frame elements at his discretion so that decoders which are able to process such additional frame elements may be fed with the frame elements within the frames 20 in an order which, for example, minimizes buffering needs within the decoder. Disadvantageously, however, the bitstream would have to convey frame element type information per frame element, the usefulness of which, in turn, negatively affects the compression rate of the bitstream 12 on the one hand and the decoding complexity on the other hand as the parsing overhead for inspecting the respective frame element type information occurs within each frame element.

Naturally, it would be possible to otherwise fix the order among the frame elements 22, such as per convention, but such a procedure prevents encoders from having the freedom to rearrange frame elements due to, for example, specific properties of future extension frame elements necessitating or suggesting, for example, a different order among the frame elements.

Accordingly, there is a need for another concept of a bitstream, encoder and decoder, respectively.

SUMMARY

According to an embodiment, a bitstream may have a configuration block and a sequence of frames respectively representing consecutive time periods of an audio content, wherein the configuration block may have a field indicating a number of elements N, and a type indication syntax portion indicating, for each element position of a sequence of N element positions, an element type out of a plurality of element types; and wherein each of the sequence of frames may have a sequence of N frame elements, wherein each frame element is of the element type indicated, by the type indication syntax portion, for the respective element position at which the respective frame element is positioned within the sequence of N frame elements of the respective frame in the bitstream.

According to another embodiment, a decoder for decoding a bitstream may have a configuration block and a sequence of frames respectively representing consecutive time periods of an audio content, wherein the configuration block may have a field indicating a number of elements N, and a type indication syntax portion indicating, for each element position of a sequence of N element positions, an element type out of a plurality of element types, and wherein each of the sequence of frames may have a sequence of N frame elements, wherein the decoder is configured to decode each frame by decoding each frame element in accordance with the element type indicated, by the type indication syntax portion, for the respective element position at which the respective frame element is positioned within the sequence of N frame elements of the respective frame in the bitstream.

According to another embodiment, an encoder for encoding of an audio content into a bitstream is configured to encode consecutive time periods of the audio content into a sequence of frames respectively representing the consecutive time periods of the audio content, such that each frame has a sequence of a number of elements N of frame elements with each frame element being of a respective one of a plurality of element types so that frame elements of the frames positioned at any common element position of a sequence of N element positions of the sequence of frame elements are of equal element type, encode into the bitstream a configuration block which has a field indicating the number of elements N, and a type indication syntax portion indicating, for each element position of the sequence of N element positions, the respective element type, and encode, for each frame, the sequence of N frame elements into the bitstream so that each frame element of the sequence of N frame elements which is positioned at a respective element position within the sequence of N frame elements in the bitstream is of the element type indicated, by the type indication portion, for the respective element position.

According to another embodiment, a method for decoding a bitstream having a configuration block and a sequence of frames respectively representing consecutive time periods of an audio content, wherein the configuration block has a field indicating a number of elements N, and a type indication syntax portion indicating, for each element position of a sequence of N element positions, an element type out of a plurality of element types, and wherein each of the sequence of frames has a sequence of N frame elements, wherein the method may have the step of decoding each frame by decoding each frame element in accordance with the element type indicated, by the type indication syntax portion, for the respective element position at which the respective frame element is positioned within the sequence of N frame elements of the respective frame in the bitstream.

According to another embodiment, a method for encoding of an audio content into a bitstream may have the steps of: encoding consecutive time periods of the audio content into a sequence of frames respectively representing the consecutive time periods of the audio content, such that each frame has a sequence of a number of elements N of frame elements with each frame element being of a respective one of a plurality of element types so that frame elements of the frames positioned at any common element position of a sequence of N element positions of the sequence of frame elements are of equal element type, encoding into the bitstream a configuration block which has a field indicating the number of elements N, and a type indication syntax portion indicating, for each element position of the sequence of N element positions, the respective element type, and encoding, for each frame, the sequence of N frame elements into the bitstream so that each frame element of the sequence of N frame elements which is positioned at a respective element position within the sequence of N frame elements in the bitstream is of the element type indicated, by the type indication portion, for the respective element position.

The present invention is based on the finding that a better compromise between a too high bitstream and decoding overhead on the one hand and flexibility of frame element positioning on the other hand may be obtained if each of the sequence of frames of the bitstream comprises a sequence of N frame elements and, on the other hand, the bitstream comprises a configuration block comprising a field indicating the number of elements N and a type indication syntax portion indicating, for each element position of the sequence of N element positions, an element type out of a plurality of element types with, in the sequences of N frame elements of the frames, each frame element being of the element type indicated, by the type indication portion, for the respective element position at which the respective frame element is positioned within the sequence of N frame elements of the respective frame in the bitstream. Thus, the frames are equally structured in that each frame comprises the same sequence of N frame elements of the frame element type indicated by the type indication syntax portion, positioned within the bitstream in the same sequential order. This sequential order is commonly adjustable for the sequence of frames by use of the type indication syntax portion which indicates, for each element position of the sequence of N element positions, an element type out of a plurality of element types.

By this measure, the frame element types may be arranged in any order, such as at the encoder's discretion, so as to choose the order which is the most appropriate for the frame element types used, for example.

The plurality of frame element types may, for example, include an extension element type with frame elements of the extension element type comprising a length information on a length of the respective frame element so that decoders not supporting the specific extension element type, are able to skip these frame elements of the extension element type using the length information as a skip interval length. On the other hand, decoders able to handle these frame elements of the extension element type accordingly process the content or payload portion thereof and as the encoder is able to freely position these frame elements of the extension element type within the sequence of frame elements of the frames, buffering overhead at the decoders may be minimized by choosing the frame element type order appropriately and signaling same within the type indication syntax portion.

Advantageous implementations of embodiments of the present invention are the subject of the dependent claims.

BRIEF DESCRIPTION OF THE DRAWINGS

Embodiments of the present invention will be detailed subsequently referring to the appended drawings, in which:

FIGS. 4 *a* to *z* and *za* to *zc* show tables of pseudo code, illustrating a concrete syntax of bitstream in accordance with an embodiment.

DETAILED DESCRIPTION OF THE INVENTION

Figure 1:
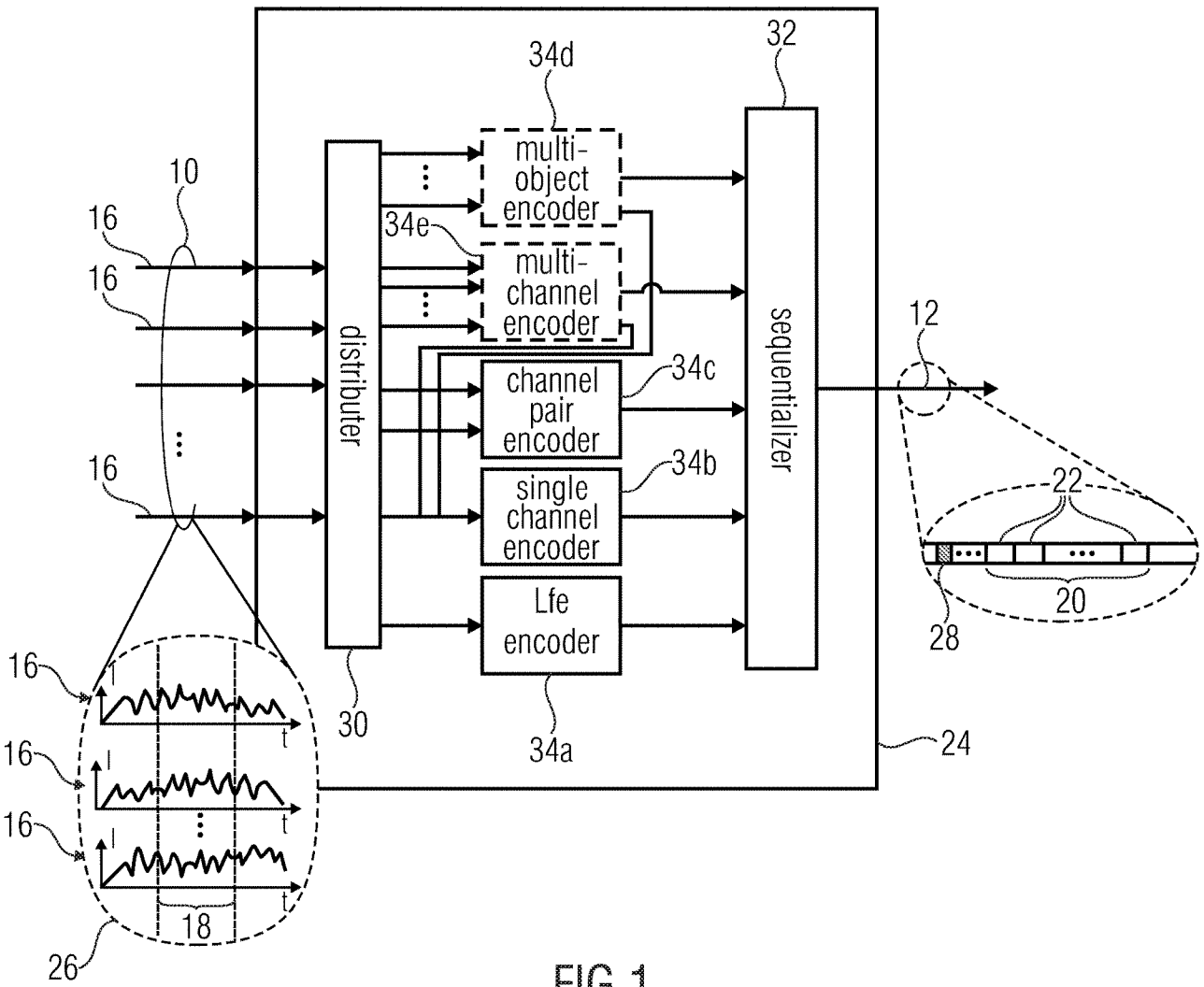
FIG. 1 shows a schematic block diagram of an encoder and its input and output in accordance with an embodiment.

FIG. 1 shows an encoder 24 in accordance with an embodiment. The encoder 24 is for encoding an audio content 10 into a bitstream 12.

As described in the introductory portion of the specification of the present application, the audio content 10 may be a conglomeration of several audio signals 16. The audio signals 16 represent, for example, individual audio channels of a spatial audio scene. Alternatively, the audio signals 16 form audio objects of a set of audio objects together defining an audio scene for free mixing at the decoding side. The audio signals 16 are defined at a common time basis t as illustrated at 26. That is, the audio signals 16 may relate to the same time interval and may, accordingly, be time aligned relative to each other.

The encoder 24 is configured to encode consecutive time periods 18 of the audio content 10 into a sequence of frames 20 so that each frame 20 represents a respective one of the time periods 18 of the audio content 10. The encoder 24 is configured to, in some sense, encode each time period in the same way such that each frame 20 comprises a sequence of an element number N of frame elements. Within each frame 20, it holds true that each frame element 22 is of a respective one of a plurality of element types and that frame elements 22 positioned at a certain element position are of the same or equal element type. That is, the first frame elements 22 in the frames 20 are of the same element type and form a first sequence (or substream) of frame elements, the second frame elements 22 of all frames 20 are of an element type equal to each other and form a second sequence of frame elements, and so forth.

In accordance with an embodiment, for example, the encoder 24 is configured such that the plurality of element types comprises the following:

a) frame elements of a single-channel element type, for example, may be generated by the encoder 24 to represent one single audio signal. Accordingly, the sequence of frame elements 22 at a certain element position within the frames 20, e.g. the $i^{th}$ element frames with 0>i>N+1, which, hence, form the substream of frame elements, would together represent consecutive time periods 18 of such a single audio signal. The audio signal thus represented could directly correspond to any one of the audio signals 16 of the audio content 10. Alternatively, however, and as will be described in more detail below, such a represented audio signal may be one channel out of a downmix signal which, along with payload data of frame elements of another frame element type, positioned at another element position within the frames 20, yields a number of audio signals 16 of the audio content 10 which is higher than the number of channels of the just-mentioned downmix signal. In case of the embodiment described in more detail below, frame elements of such single-channel element type are denoted UsacSingleChannelElement. In the case of MPEG Surround and SAOC, for example, there is only a single downmix signal, which can be mono, stereo, or even multichannel in the case of MPEG Surround. In the latter case the, e.g. 5.1 downmix, consists of two channel pair elements and one single channel element. In this case the single channel element, as well as the two channel pair elements, are only a part of the downmix signal. In the stereo downmix case, a channel pair element will be used.

b) Frame elements of a channel pair element type may be generated by the encoder 24 so as to represent a stereo pair of audio signals. That is, frame elements 22 of that type, which are positioned at a common element position within the frames 20, would together form a respective substream of frame elements which represent consecutive time periods 18 of such a stereo audio pair. The stereo pair of audio signals thus represented could be directly any pair of audio signals 16 of the audio content 10, or could represent, for example, a downmix signal, which along with payload data of frame elements of another element type that are positioned at another element position yield a number of audio signals 16 of the audio content 10 which is higher than 2. In the embodiment described in more detail below, frame elements of such channel pair element type are denoted as UsacChannelPairElement.

c) In order to convey information on audio signals 16 of the audio content 10 which need less bandwidth such as subwoofer channels or the like, the encoder 24 may support frame elements of a specific type with frame elements of such a type, which are positioned at a common element position, representing, for example, consecutive time periods 18 of a single audio signal. This audio signal may be any one of the audio signals 16 of the audio content 10 directly, or may be part of a downmix signal as described before with respect to the single channel element type and the channel pair element type. In the embodiment described in more detail below, frame elements of such a specific frame element type are denoted UsacLfeElement.

d) Frame elements of an extension element type could be generated by the encoder 24 so as to convey side information along with a bitstream so as to enable the decoder to upmix any of the audio signals represented by frame elements of any of the types a, b and/or c to obtain a higher number of audio signals. Frame elements of such an extension element type, which are positioned at a certain common element position within the frames 20, would accordingly convey side information relating to the consecutive time period 18 that enables upmixing the respective time period of one or more audio signals represented by any of the other frame elements so as to obtain the respective time period of a higher number of audio signals, wherein the latter ones may correspond to the original audio signals 16 of the audio content 10. Examples for such side information may, for example, be parametric side information such as, for example, MPS or SAOC side information.

In accordance with the embodiment described in detail below, the available element types merely consist of the above outlined four element types, but other element types may be available as well. On the other hand, only one or two of the element types a to c may be available.

As became clear from the above discussion, the omission of frame elements 22 of the extension element type from the bitstream 12 or the neglection of these frame elements in decoding, does not completely render the reconstruction of the audio content 10 impossible: at least, the remaining frame elements of the other element types convey enough information to yield audio signals. These audio signals do not necessarily correspond to the original audio signals of the audio content 10 or a proper subset thereof, but may represent a kind of "amalgam" of the audio content 10. That is, frame elements of the extension element type may convey information (payload data) which represents side information with respect to one or more frame elements positioned at different element positions within frames 20.

In the embodiment described below, however, frame elements of the extension element type are not restricted to such a kind of side information conveyance. Rather, frame elements of the extension element type are, in the following, denoted UsacExtElement and are defined to convey payload data along with length information wherein the latter length information enables decoders receiving the bitstream 12, so as to skip these frame elements of the extension element type in case of, for example, the decoder being unable to process the respective payload data within these frame elements. This is described in more detail below.

Before proceeding with the description of the encoder of FIG. 1, however, it should be noted that there are several possibilities for alternatives for the element types described above. This is especially true for the extension element type described above. In particular, in case of the extension element type being configured such that the payload data thereof is skippable by decoders which are, for example, not able to process the respective payload data, the payload data of these extension element type frame elements could be any payload data type. This payload data could form side information with respect to payload data of other frame elements of other frame element types, or could form self-contained payload data representing another audio signal, for example. Moreover, even in case of the payload data of the extension element type frame elements representing side information of payload data of frame elements of other frame element types, the payload data of these extension element type frame elements is not restricted to the kind just-described, namely multi-channel or multi-object side information. Multi-channel side information payload accompanies, for example, a downmix signal represented by any of the frame elements of the other element type, with spatial cues such as binaural cue coding (BCC) parameters such as inter channel coherence values (ICC), inter channel level differences (ICLD), and/or inter channel time differences (ICTD) and, optionally, channel prediction coefficients, which parameters are known in the art from, for example, the MPEG Surround standard. The just mentioned spatial cue parameters may, for example, be transmitted within the payload data of the extension element type frame elements in a time/frequency resolution, i.e. one parameter per time/frequency tile of the time/frequency grid. In case of multi-object side information, the payload data of the extension element type frame element may comprise similar information such as inter-object cross-correlation (IOC) parameters, object level differences (OLD) as well as downmix parameters revealing how original audio signals have been downmixed into a channel(s) of a downmix signal represented by any of the frame elements of another element type. Latter parameters are, for example, known in the art from the SAOC standard. However, an example of a different side information which the payload data of extension element type frame elements could represent is, for example, SBR data for parametrically encoding an envelope of a high frequency portion of an audio signal represented by any of the frame elements of the other frame element types, positioned at a different element position within frames 20 and enabling, for example, spectral band replication by use of the low frequency portion as obtained from the latter audio signal as a basis for the high-frequency portion with then forming the envelope of the high frequency portion thus obtained by the SBR data's envelope. More generally, the payload data of frame elements of the extension element type could convey side information for modifying audio signals represented by frame elements of any of the other element types, positioned at a different element position within frame 20, either in the time domain or in the frequency domain wherein the frequency domain may, for example, be a QMF domain or some other filterbank domain or transform domain.

Proceeding further with the description of the functionality of encoder 24 of FIG. 1, same is configured to encode into the bitstream 12 a configuration block 28 which comprises a field indicating the number of elements N, and a type indication syntax portion indicating, for each element position of the sequence of N element positions, the respective element type. Accordingly, the encoder 24 is configured to encode, for each frame 20, the sequence of N frame elements 22 into the bitstream 12 so that each frame element 22 of the sequence of N frame elements 22, which is positioned at a respective element position within the sequence of N frame elements 22 in the bitstream 12, is of the element type indicated by the type indication portion for the respective element position. In other words, the encoder 24 forms N substreams, each of which is a sequence of frame elements 22 of a respective element type. That is, for all of these N substreams, the frame elements 22 are of equal element type, while frame elements of different substreams may be of a different element type. The encoder 24 is configured to multiplex all of these frame elements into bitstream 12 by concatenating all N frame elements of these substreams concerning one common time period 18 to form one frame 20. Accordingly, in the bitstream 12 these frame elements 22 are arranged in frames 20. Within each frame 20, the representatives of the N substreams, i.e. the N frame elements concerning the same time period 18, are arranged in the static sequential order defined by the sequence of element positions and the type indication syntax portion in the configuration block 28, respectively.

By use of the type indication syntax portion, the encoder 24 is able to freely choose the order, using which the frame elements 22 of the N substreams are arranged within frames 20. By this measure, the encoder 24 is able to keep, for example, buffering overhead at the decoding side as low as possible. For example, a substream of frame elements of the extension element type which conveys side information for frame elements of another substream (base substream), which are of a non-extension element type, may be positioned at an element position within frames 20 immediately succeeding the element position at which these base substream frame elements are located in the frames 20. By this measure, the buffering time during which the decoding side has to buffer results, or intermediate results, of the decoding of the base substream for an application of the side information thereon, is kept low, and the buffering overhead may be reduced. In case of the side information of the payload data of frame elements of a substream, which are of the extension element type, being applied to an intermediate result, such as a frequency domain, of the audio signal represented by another substream of frame elements 22 (base substream), the positioning of the substream of extension element type frame elements 22 so that same immediately follows the base substream, does not only minimize the buffering overhead, but also the time duration during which the decoder may have to interrupt further processing of the reconstruction of the represented audio signal because, for example, the payload data of the extension element type frame elements is to modify the reconstruction of the audio signal relative to the base substream's representation. It might, however, also be favorable to position a dependent extension substream prior to its base substream representing an audio signal, to which the extension substream refers, For example, the encoder 24 is free to position the substream of extension payload within the bitstream upstream relative to a channel element type substream. For example, the extension payload of substream i could convey dynamic range control (DRC) data and is transmitted prior to, or at an earlier element position i, relative to the coding of the corresponding audio signal, such as via frequency domain (FD) coding, within channel substream at element position i+1, for example. Then, the decoder is able to use the DRC immendiately when decoding and reconstructing the audio signal represented by non-extension type substream i+1.

The encoder 24 as described so far represents a possible embodiment of the present application. However, FIG. 1 also shows a possible internal structure of the encoder which is to be understood merely as an illustration. As shown in FIG. 1, the encoder 24 may comprise a distributer 30 and a sequentializer 32 between which various encoding modules 34*a-e* are connected in a manner described in more detail in the following. In particular, the distributer 30 is configured to receive the audio signals 16 of the audio content 10 and to distribute same onto the individual encoding modules 34*a-e*. The way the distributer 30 distributes the consecutive time periods 18 of the audio signal 16 onto the encoding modules 34*a* to 34*e* is static. In particular, the distribution may be such that each audio signal 16 is forwarded to one of the encoding modules 34*a* to 34*e* exclusively. An audio signal fed to LFE encoder 34*a* is encoded by LFE encoder 34*a* into a substream of frame elements 22 of type c (see above), for example. Audio signals fed to an input of single channel encoder 34*b* are encoded by the latter into a substream of frame elements 22 of type a (see above), for example. Similarly, a pair of audio signals fed to an input of channel pair encoder 34*c* is encoded by the latter into a substream of frame elements 22 of type d (see above), for example. The just mentioned encoding modules 34*a* to 34*c* are connected with an input and output thereof between distributer 30 on the one hand and sequentializer 32 on the other hand.

As is shown in FIG. 1, however, the inputs of encoder modules 34*b* and 34*c* are not only connected to the output interface of distributer 30. Rather, same may be fed by an output signal of any of encoding modules 34*d* and 34*e*. The latter encoding modules 34*d* and 34*e* are examples of encoding modules which are configured to encode a number of inbound audio signals into a downmix signal of a lower number of downmix channels on the one hand, and a substream of frame elements 22 of type d (see above), on the other hand. As became clear from the above discussion, encoding module 34*d* may be a SAOC encoder, and encoding module 34*e* may be a MPS encoder. The downmix signals are forwarded to either of encoding modules 34*b* and 34*c*. The substreams generated by encoding modules 34*a* to 34*e* are forwarded to sequentializer 32 which sequentializes the substreams into the bitstream 12 as just described. Accordingly, encoding modules 34*d* and 34*e* have their input for the number of audio signals connected to the output interface of distributer 30, while their substream output is connected to an input interface of sequentializer 32, and their downmix output is connected to inputs of encoding modules 34*b* and/or 34*c*, respectively.

It should be noted that in accordance with the description above the existence of the multi-object encoder 34*d* and multi-channel encoder 34*e* has merely been chosen for illustrative purposes, and either one of these encoding modules 34*d* and 34*e* may be left away or replaced by another encoding module, for example.

Figure 2:
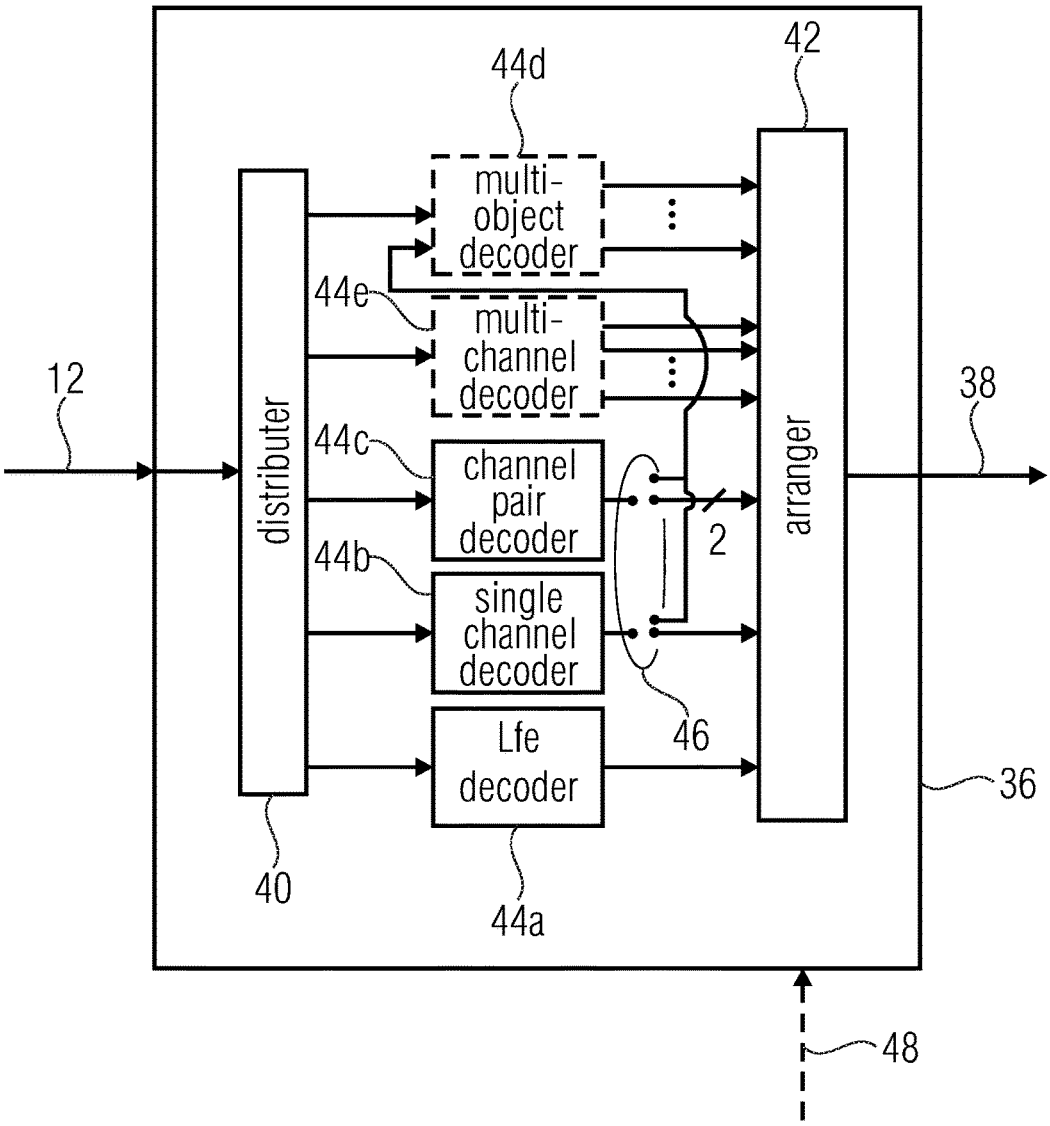
FIG. 2 shows a schematic block diagram of a decoder and its input and output in accordance with an embodiment.

After having described the encoder 24 and the possible internal structure thereof, a corresponding decoder is described with respect to FIG. 2. The decoder of FIG. 2 is generally indicated with reference sign 36 and has an input in order to receive the bitstream 12 and an output for outputting a reconstructed version 38 of the audio content 10 or an amalgam thereof. Accordingly, the decoder 36 is configured to decode the bitstream 12 comprising the configuration block 28 and the sequence of frames 20 shown in FIG. 1, and to decode each frame 20 by decoding the frame elements 22 in accordance with the element type indicated, by the type indication portion, for the respective element position at which the respective frame element 22 is positioned within the sequence of N frame elements 22 of the respective frame 20 in the bitstream 12. That is, the decoder 36 is configured to assign each frame element 22 to one of the possible element types depending on its element position within the current frame 20 rather than any information within the frame element itself. By this measure, the decoder 36 obtains N substreams, the first substream made up of the first frame elements 22 of the frames 20, the second substream made up of the second frame elements 22 within frames 20, the third substream made up of the third frame elements 22 within frames 20 and so forth.

Before describing the functionality of decoder 36 with respect to extension element type frame elements in more detail, a possible internal structure of decoder 36 of FIG. 2 is explained in more detail so as to correspond to the internal structure of encoder 24 of FIG. 1. As described with respect to the encoder 24, the internal structure is to be understood merely as being illustrative.

In particular, as shown in FIG. 2, the decoder 36 may internally comprise a distributer 40 and an arranger 42 between which decoding modules 44*a* to 44*e* are connected. Each decoding module 44*a* to 44*e* is responsible for decoding a substream of frame elements 22 of a certain frame element type. Accordingly, distributer 40 is configured to distribute the N substreams of bitstream 12 onto the decoding modules 44*a* to 44*e* correspondingly. Decoding module 44*a*, for example, is an LFE decoder which decodes a substream of frame elements 22 of type c (see above) so as to obtain a narrowband (for example) audio signal at its output. Similarly, single-channel decoder 44*b* decodes an inbound substream of frame elements 22 of type a (see above) to obtain a single audio signal at its output, and channel pair decoder 44*c* decodes an inbound substream of frame elements 22 of type b (see above) to obtain a pair of audio signals at its output. Decoding modules 44*a* to 44*c* have their input and output connected between output interface of distributer 40 on the one hand and input interface of arranger 42 on the other hand.

Decoder 36 may merely have decoding modules 44*a* to 44*c*. The other decoding modules 44*e* and 44*d* are responsible for extension element type frame elements and are, accordingly, optional as far as the conformity with the audio codec is concerned. If both or any of these extension modules 44*e* to 44*d* are missing, distributer 40 is configured to skip respective extension frame element substreams in the bitstream 12 as described in more detail below, and the reconstructed version 38 of the audio content 10 is merely an amalgam of the original version having the audio signals 16.

If present, however, i.e. if the decoder 36 supports SAOC and/or MPS extension frame elements, the multi-channel decoder 44*e* may be configured to decode substreams generated by encoder 34*e*, while multi-object decoder 44*d* is responsible for decoding substreams generated by multi-object encoder 34*d*. Accordingly, in case of decoding module 44*e* and/or 44*d* being present, a switch 46 may connect the output of any of decoding modules 44*c* and 44*b* with a downmix signal input of decoding module 44*e* and/or 44*d*. The multi-channel decoder 44*e* may be configured to up-mix an inbound downmix signal using side information within the inbound substream from distributer 40 to obtain an increased number of audio signals at its output. Multi-object decoder 44*d* may act accordingly with the difference that multi-object decoder 44*d* treats the individual audio signals as audio objects whereas the multi-channel decoder 44*e* treats the audio signals at its output as audio channels.

The audio signals thus reconstructed are forwarded to arranger 42 which arranges them to form the reconstruction 38. Arranger 42 may be additionally controlled by user input 48, which user input indicates, for example, an available loudspeaker configuration or a highest number of channels of the reconstruction 38 allowed. Depending on the user input 48, arranger 42 may disable any of the decoding modules 44*a* to 44*e* such as, for example, any of the extension modules 44*d* and 44*e*, although present and although extension frame elements are present in the bitstream 12.

Before describing further possible details of the decoder, encoder and bitstream, respectively, it should be noted that owning to the ability of the encoder to intersperse frame elements of substreams which are of the extension element type, inbetween frame elements of substreams, which are not of the extension element type, buffer overhead of decoder 36 may be lowered by the encoder 24 appropriately choosing the order among the substreams and the order among the frame elements of the substreams within each frame 20, respectively. Imagine, for example, that the substream entering channel pair decoder 44*c* would be placed at the first element position within frame 20, while multi-channel substream for decoder 44*e* would be placed at the end of each frame. In that case, the decoder 36 would have to buffer the intermediate audio signal representing the downmix signal for multi-channel decoder 44*e* for a time period bridging the time between the arrival of the first frame element and the last frame element of each frame 20, respectively. Only then is the multi-channel decoder 44*e* able to commence its processing. This deferral may be avoided by the encoder 24 arranging the substream dedicated for multi-channel decoder 44*e* at the second element position of frames 20, for example. On the other hand, distributer 40 does not need to inspect each frame element with respect to its membership to any of the substreams. Rather, distributer 40 is able to deduce the membership of a current frame element 22 of a current frame 20 to any of the N substreams merely from the configuration block and the type indication syntax portion contained therein.

Figure 3:
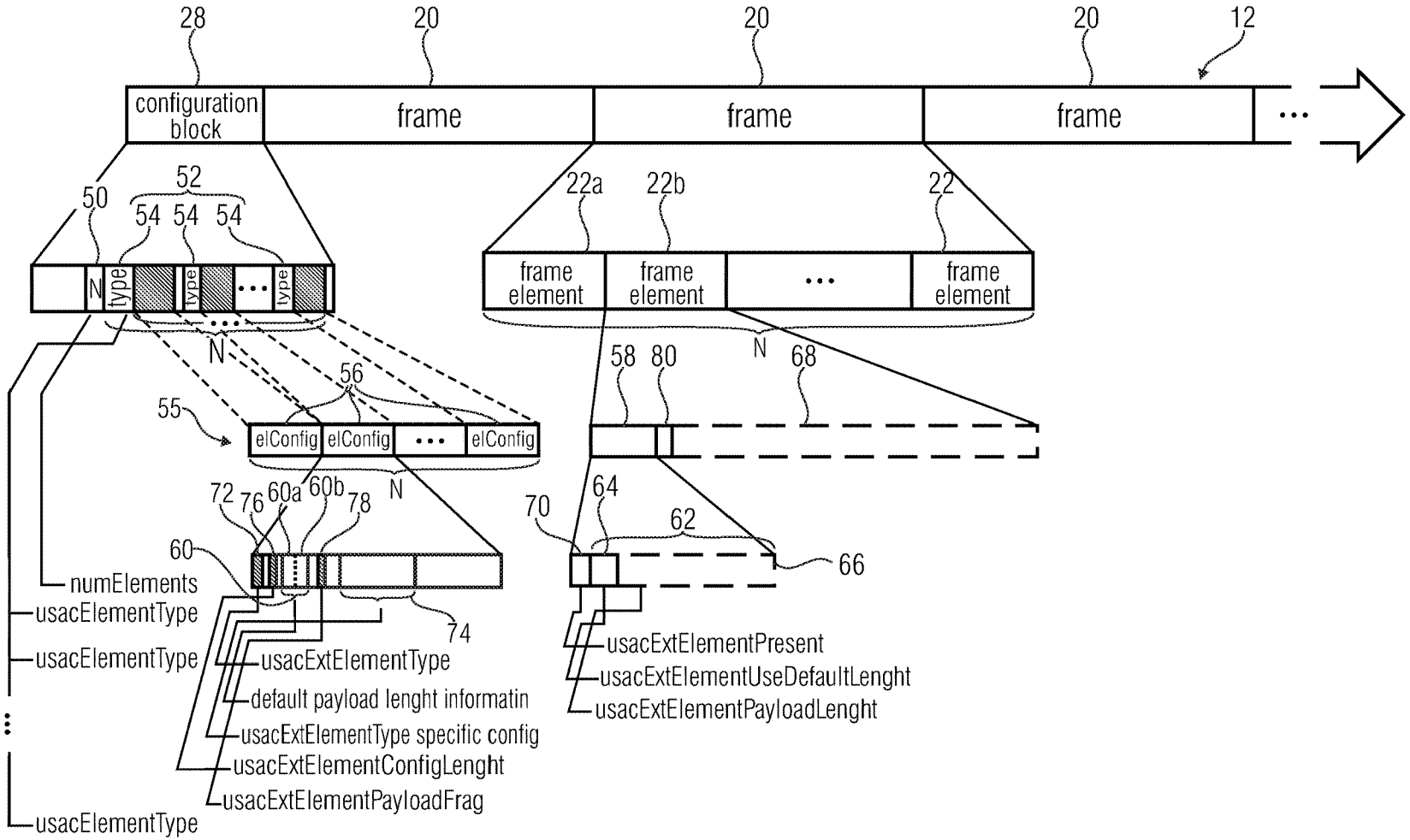
FIG. 3 schematically shows a bitstream in accordance with an embodiment.

Reference is now made to FIG. 3 showing a bitstream 12 which comprises, as already described above, a configuration block 28 and a sequence of frames 20. Bitstream portions to the right follow other bitstream portion's positions to the left when look at FIG. 3. In the case of FIG. 3, for example, configuration block 28 precedes the frames 20 shown in FIG. 3 wherein, for illustrative purposes only, merely three frames 20 are completely shown in FIG. 3.

Further, it should be noted that the configuration block 28 may be inserted into the bitstream 12 in between frames 20 on a periodic or intermittent basis to allow for random access points in streaming transmission applications. Generally speaking, the configuration block 28 may be a simply-connected portion of the bitstream 12.

The configuration block 28 comprises, as described above, a field 50 indicating the number of elements N, i.e. the number of frame elements N within each frame 20 and the number of substreams multiplexed into bitstream 12 as described above. In the following embodiment describing an embodiment for a concrete syntax of bitstream 12, field 50 is denoted numElements and the configuration block 28 called UsacConfig in the following specific syntax example of FIGS. 4*a-z* and *za-zc*. Further, the configuration block 28 comprises a type indication syntax portion 52. As already described above, this portion 52 indicates for each element position an element type out of a plurality of element types. As shown in FIG. 3 and as is the case with respect to the following specific syntax example, the type indication syntax portion 52 may comprise a sequence of N syntax elements 54 which each syntax element 54 indicating the element type for the respective element position at which the respective syntax element 54 is positioned within the type indication syntax portion 52. In other words, the $i^{th}$ syntax element 54 within portion 52 may indicate the element type of the $i^{th}$ substream and $i^{th}$ frame element of each frame 20, respectively. In the subsequent concrete syntax example, the syntax element is denoted UsacElementType. Although the type indication syntax portion 52 could be contained within the bitstream 12 as a simply-connected or contiguous portion of the bitstream 12, it is exemplarily shown in FIG. 3 that the elements 54 thereof are intermeshed with other syntax element portions of the configuration block 28 which are present for each of the N element positions individually. In the below-outlined embodiments, this intermeshed syntax portions pertains the substream-specific configuration data 55 the meaning of which is described in the following in more detail.

As already described above, each frame 20 is composed of a sequence of N frame elements 22. The element types of these frame elements 22 are not signaled by respective type indicators within the frame elements 22 themselves. Rather, the element types of the frame elements 22 are defined by their element position within each frame 20. The frame element 22 occurring first in the frame 20, denoted frame element 22*a* in FIG. 3, has the first element position and is accordingly of the element type which is indicated for the first element position by syntax portion 52 within configuration block 28. The same applies with respect to the following frame elements 22. For example, the frame element 22*b* occurring immediately after the first frame element 22*a* within bitstream 12, i.e. the one having element position 2, is of the element type indicated by syntax portion 52.

In accordance with a specific embodiment, the syntax elements 54 are arranged within bitstream 12 in the same order as the frame elements 22 to which they refer. That is, the first syntax element 54, i.e. the one occurring first in the bitstream 12 and being positioned at the outermost left-hand side in FIG. 3, indicates the element type of the first occurring frame element 22*a* of each frame 20, the second syntax element 54 indicates the element type of the second frame element 22*b* and so forth. Naturally, the sequential order or arrangement of syntax elements 54 within bitstream 12 and syntax portions 52 may be switched relative to the sequential order of frame elements 22 within frames 20. Other permutations would also be feasible although less advantageous.

For the decoder 36, this means that same may be configured to read this sequence of N syntax elements 54 from the type indication syntax portion 52. To be more precise, the decoder 36 reads field 50 so that decoder 36 knows about the number N of syntax elements 54 to be read from bitstream 12. As just mentioned, decoder 36 may be configured to associate the syntax elements and the element type indicated thereby with the frame elements 22 within frames 20 so that the $i^{th}$ syntax element 54 is associated with the $i^{th}$ frame element 22.

In addition to the above description, the configuration block 28 may comprise a sequence 55 of N configuration elements 56 with each configuration element 56 comprising configuration information for the element type for the respective element position at which the respective configuration element 56 is positioned in the sequence 55 of N configuration elements 56. In particular, the order in which the sequence of configuration elements 56 is written into the bitstream 12 (and read from the bitstream 12 by decoder 36) may be the same order as that used for the frame elements 22 and/or the syntax elements 54, respectively. That is, the configuration element 56 occurring first in the bitstream 12 may comprise the configuration information for the first frame element 22*a*, the second configuration element 56, the configuration information for frame element 22*b* and so forth. As already mentioned above, the type indication syntax portion 52 and the element-position-specific configuration data 55 is shown in the embodiment of FIG. 3 as being interleaved which each other in that the configuration element 56 pertaining element position i is positioned in the bitstream 12 between the type indicator 54 for element position i and element position i+1. In even other words, configuration elements 56 and the syntax elements 54 are arranged in the bitstream alternately and read therefrom alternately by the decoder 36, but other positioning if this data in the bistream 12 within block 28 would also be feasible as mentioned before.

By conveying a configuration element 56 for each element position 1 . . . N in configuration block 28, respectively, the bitstream allows for differently configuring frame elements belonging to different substreams and element positions, respectively, but being of the same element type. For example, a bitstream 12 may comprise two single channel substreams and accordingly two frame elements of the single channel element type within each frame 20. The configuration information for both substreams may, however, be adjusted differently in the bitstream 12. This, in turn, means that the encoder 24 of FIG. 1 is enabled to differently set coding parameters within the configuration information for these different substreams and the single channel decoder 44*b* of decoder 36 is controlled by using these different coding parameters when decoding these two substreams. This is also true for the other decoding modules. More generally speaking, the decoder 36 is configured to read the sequence of N configuration elements 56 from the configuration block 28 and decodes the frame element 22 in accordance with the element type indicated by the $i^{th}$ syntax element 54, and using the configuration information comprised by the $i^{th}$ configuration element 56.

For illustrative purposes, it is assumed in FIG. 3 that the second substream, i.e. the substream composed of the frame elements 22*b* occurring at the second element position within each frame 20, has an extension element type substream composed of frame elements 22*b* of the extension element type. Naturally, this is merely illustrative.

Further, it is only for illustrative purposes that the bitstream or configuration block 28 comprises one configuration element 56 per element position irrespective of the element type indicated for that element position by syntax portion 52. In accordance with an alternative embodiment, for example, there may be one or more element types for which no configuration element is comprised by configuration block 28 so that, in the latter case, the number of configuration elements 56 within configuration block 28 may be less than N depending on the number of frame elements of such element types occurring in syntax portion 52 and frames 20, respectively.

In any case, FIG. 3 shows a further example for building configuration elements 56 concerning the extension element type. In the subsequently explained specific syntax embodiment, these configuration elements 56 are denoted UsacExtElementConfig. For completeness only, it is noted that in the subsequently explained specific syntax embodiment, configuration elements for the other element types are denoted UsacSingleChannelElementConfig, UsacChannelPairElementConfig and UsacLfeElementConfig.

However, before describing a possible structure of a configuration element 56 for the extension element type, reference is made to the portion of FIG. 3 showing a possible structure of a frame element of the extension element type, here illustratively the second frame element 22*b*. As shown therein, frame elements of the extension element type may comprise a length information 58 on a length of the respective frame element 22*b*. Decoder 36 is configured to read, from each frame element 22*b* of the extension element type of every frame 20, this length information 58. If the decoder 36 is not able to, or is instructed by user input not to, process the substream to which this frame element of the extension element type belongs, decoder 36 skips this frame element 22*b* using the length information 58 as skip interval length, i.e. the length of the portion of the bitstream to be skipped. In other words, the decoder 36 may use the length information 58 to compute the number of bytes or any other suitable measure for defining a bitstream interval length, which is to be skipped until accessing or visiting the next frame element within the current frame 20 or the starting of the next following frame 20, so as to further prosecute reading the bitstream 12.

As will be described in more detail below, frame elements of the extension element type may be configured to accommodate for future or alternative extensions or developments of the audio codec and accordingly frame elements of the extension element type may have different statistical length distributions. In order to take advantage of the possibility that in accordance with some applications the extension element type frame elements of a certain substream are of constant length or have a very narrow statistical length distribution, in accordance with some embodiments of the present application, the configuration elements 56 for extension element type may comprise default payload length information 60 as shown in FIG. 3. In that case, it is possible for the frame elements 22*b* of the extension element type of the respective substream, to refer to this default payload length information 60 contained within the respective configuration element 56 for the respective substream instead of explicitly transmitting the payload length. In particular, as shown in FIG. 3, in that case the length information 58 may comprise a conditional syntax portion 62 in the form of a default extension payload length flag 64 followed, if the default payload length flag 64 is not set, by an extension payload length value 66. Any frame element 22*b* of the extension element type has the default extension payload length as indicated by information 60 in the corresponding configuration element 56 in case the default extension payload length flag 64 of the length information 62 of the respective frame element 22*b* of the extension element type is set, and has an extension payload length corresponding to the extension payload length value 66 of the length information 58 of the respective frame element 22*b* of the extension element type in case of the default extension payload length flag 64 of the length information 58 of the respective frame 22*b* of the extension element type is not set. That is, the explicit coding of the extension payload length value 66 may be avoided by the encoder 24 whenever it is possible to merely refer to the default extension payload length as indicated by the default payload length information 60 within the configuration element 56 of the corresponding substream and element position, respectively. The decoder 36 acts as follows. Same reads the default payload length information 60 during the reading of the configuration element 56. When reading the frame element 22*b* of the corresponding substream, the decoder 36, in reading the length information of these frame elements, reads the default extension payload length flag 64 and checks whether same is set or not. If the default payload length flag 64 is not set, the decoder proceeds with reading the extension payload length value 66 of the conditional syntax portion 62 from the bitstream so as to obtain an extension payload length of the respective frame element. However, if the default payload flag 64 is set, the decoder 36 sets the extension payload length of the respective frame to be equal to the default extension payload length as derived from information 60. The skipping of the decoder 36 may then involve skipping a payload section 68 of the current frame element using the extension payload length just determined as the skip interval length, i.e. the length of a portion of the bitstream 12 to be skipped so as to access the next frame element 22 of the current frame 20 or the beginning of the next frame 20.

Accordingly, as previously described, the frame-wise repeated transmission of the payload length of the frame elements of an extension element type of a certain substream may be avoided using flag mechanism 64 whenever the variety of the payload length of these frame elements is rather low.

However, since it is not a priori clear whether the payload conveyed by the frame elements of an extension element type of a certain substream has such a statistic regarding the payload length of the frame elements, and accordingly whether it is worthwhile to transmit the default payload length explicitly in the configuration element of such a substream of frame elements of the extension element type, in accordance with further embodiment, the default payload length information 60 is also implemented by a conditional syntax portion comprising a flag 60*a* called UsacExtElementDefaultLengthPresent in the following specific syntax example, and indicating whether or not an explicit transmission of the default payload length takes place. Merely if set, the conditional syntax portion comprises the explicit transmission 60*b* of the default payload length called UsacExtElementDefaultLength in the following specific syntax example. Otherwise, the default payload length is by default set to 0. In the latter case, bitstream bit consumption is saved as an explicit transmission of the default payload length is avoided. That is, the decoder 36 (and distributor 40 which is responsible for all reading procedures described hereinbefore and hereinafter), may be configured to, in reading the default payload length information 60, read a default payload length present flag 60*a* from the bitstream 12, check as to whether the default payload length present flag 60*a* is set, and if the default payload length present flag 60*a* is set, set the default extension payload length to be zero, and if the default payload length present flag 60*a* is not set, explicitly read the default extension payload length 60*b* from the bit stream 12 (namely, the field 60*b* following flag 60*a*).

In addition to, or alternatively to the default payload length mechanism, the length information 58 may comprise an extension payload present flag 70 wherein any frame element 22*b* of the extension element type, the extension payload present flag 70 of the length information 58 of which is not set, merely consists of the extension payload present flag and that's it. That is, there is no payload section 68. On the other hand, the length information 58 of any frame element 22*b* of the extension element type, the payload data present flag 70 of the length information 58 of which is set, further comprises a syntax portion 62 or 66 indicating the extension payload length of the respective frame 22*b*, i.e. the length of its payload section 68. In addition to the default payload length mechanism, i.e. in combination with the default extension payload length flag 64, the extension payload present flag 70 enables providing each frame element of the extension element type with two effectively codable payload lengths, namely 0 on the one hand and the default payload length, i.e. the most probable payload length, on the other hand.

In parsing or reading the length information 58 of a current frame element 22*b* of the extension element type, the decoder 36 reads the extension payload present flag 70 from the bitstream 12, checks whether the extension payload present flag 70 is set, and if the extension payload present flag 70 is not set, ceases reading the respective frame element 22*b* and proceeds with reading another, next frame element 22 of the current frame 20 or starts with reading or parsing the next frame 20. Whereas if the payload data present flag 70 is set, the decoder 36 reads the syntax portion 62 or at least portion 66 (if flag 64 is non-existent since this mechanism is not available) and skips, if the payload of the current frame element 22 is to be skipped, the payload section 68 by using the extension payload length of the respective frame element 22*b* of the extension element type as the skip interval length.

As described above, frame elements of the extension element type may be provided in order to accommodate for future extensions of the audio codec or alternative extensions which the current decoder is not suitable for, and accordingly frame elements of the extension element type should be configurable. In particular, in accordance with an embodiment, the configuration block 28 comprises, for each element position for which the type indication portion 52 indicates the extension element type, a configuration element 56 comprising configuration information for the extension element type, wherein the configuration information comprises, in addition or alternatively to the above outlined components, an extension element type field 72 indicating a payload data type out of a plurality of payload data types. The plurality of payload data types may, in accordance with one embodiment, comprise a multi-channel side information type and a multi-object coding side information type besides other data types which are, for example, reserved for future developments. Depending of the payload data type indicated, the configuration element 56 additionally comprises a payload data type specific configuration data. Accordingly, the frame elements 22*b* at the corresponding element position and of the respective substream, respectively, convey in its payload sections 68 payload data corresponding to the indicated payload data type. In order to allow for an adaption of the length of the payload data type specific configuration data 74 to the payload data type, and to allow for the reservation for future developments of further payload data types, the specific syntax embodiments described below have the configuration elements 56 of extension element type additionally comprising a configuration element length value called UsacExtElementConfigLength so that decoders 36 which are not aware of the payload data type indicated for the current substream, are able to skip the configuration element 56 and its payload data type specific configuration data 74 to access the immediately following portion of the bitstream 12 such as the element type syntax element 54 of the next element position (or in the alternative embodiment not shown, the configuration element of the next element position) or the beginning of the first frame following the configuration block 28 or some other data as will be shown with respect to FIG. 4*a*. In particular, in the following specific embodiment for a syntax, multi-channel side information configuration data is contained in SpatialSpecificConfig, while multi-object side information configuration data is contained within SaocSpecificConfig.

In accordance with the latter aspect, the decoder 36 would be configured to, in reading the configuration block 28, perform the following steps for each element position or substream for which the type indication portion 52 indicates the extension element type:

Reading the configuration element 56, including reading the extension element type field 72 indicating the payload data type out of the plurality of available payload data types, If the extension element type field 72 indicates the multi-channel side information type, reading multi-channel side information configuration data 74 as part of the configuration information from the bitstream 12, and if the extension element type field 72 indicates the multi-object side information type, reading multi-object side-information configuration data 74 as part of the configuration information from the bitstream 12.

Then, in decoding the corresponding frame elements 22*b*, i.e. the ones of the corresponding element position and substream, respectively, the decoder 36 would configure the multi-channel decoder 44*e* using the multi-channel side information configuration data 74 while feeding the thus configured multi-channel decoder 44*e* payload data 68 of the respective frame elements 22*b* as multi-channel side information, in case of the payload data type indicating the multi-channel side information type, and decode the corresponding frame elements 22*b* by configuring the multi-object decoder 44*d* using the multi-object side information configuration data 74 and feeding the thus configured multi-object decoder 44*d* with payload data 68 of the respective frame element 22*b*, in case of the payload data type indicating the multi-object side information type.

However, if an unknown payload data type is indicated by field 72, the decoder 36 would skip payload data type specific configuration data 74 using the aforementioned configuration length value also comprised by the current configuration element.

For example, the decoder 36 could be configured to, for any element position for which the type indication portion 52 indicates the extension element type, read a configuration data length field 76 from the bitstream 12 as part of the configuration information of the configuration element 56 for the respective element position so as to obtain a configuration data length, and check as to whether the payload data type indicated by the extension element type field 72 of the configuration information of the configuration element for the respective element position, belongs to a predetermined set of payload data types being a subset of the plurality of payload data types. If the payload data type indicated by the extension element type field 72 of the configuration information of the configuration element for the respective element position, belongs to the predetermined set of payload data types, decoder 36 would read the payload data dependent configuration data 74 as part of the configuration information of the configuration element for the respective element position from the data stream 12, and decode the frame elements of the extension element type at the respective element position in the frames 20, using the payload data dependent configuration data 74. But if the payload data type indicated by the extension element type field 72 of the configuration information of the configuration element for the respective element position, does not belong to the predetermined set of payload data types, the decoder would skip the payload data dependent configuration data 74 using the configuration data length, and skip the frame elements of the extension element type at the respective element position in the frames 20 using the length information 58 therein.

In addition to, or alternative to the above mechanisms, the frame elements of a certain substream could be configured to be transmitted in fragments rather than one per frame completely. For example, the configuration elements of extension element types could comprises an fragmentation use flag 78, the decoder could be configured to, in reading frame elements 22 positioned at any element position for which the type indication portion indicates the extension element type, and for which the fragmentation use flag 78 of the configuration element is set, read a fragment information 80 from the bitstream 12, and use the fragment information to put payload data of these frame elements of consecutive frames together. In the following specific syntax example, each extension type frame element of a substream for which the fragmentation use flag 78 is set, comprises a pair of a start flag indicating a start of a payload of the substream, and an end flag indicating an end of a payload item of the substream. These flags are called usacExtElementStart and usacExtElementStop in the following specific syntax example.

Further, in addition to, or alternative to the above mechanisms, the same variable length code could be used to read the length information 80, the extension element type field 72, and the configuration data length field 76, thereby lowering the complexity to implement the decoder, for example, and saving bits by using additional bits merely in seldomly occurring cases such as future extension element types, greater extension element type lengths and so forth. In the subsequently explained specific example, this VLC code is derivable from FIG. 4*m*.

Summarizing the above, the following could apply for the decoder's functionality:

(1) Reading the configuration block 28, and (2) Reading/parsing the sequence of frames 20. Step 1 and 2 are performed by decoder 36 and, more precisely, distributor 40.

(3) A reconstruction of the audio content is restricted to those substreams, i.e. to those sequences of frame elements at element positions, the decoding of which is supported by the decoder 36. Step 3 is performed within decoder 36 at, for example, the decoding modules thereof (see FIG. 2).

Accordingly, in step 1 the decoder 36 reads the number 50 of substreams and the number of frame elements 22 per frame 20, respectively, as well as the element type syntax portion 52 revealing the element type of each of these substreams and element positions, respectively. For parsing the bitstream in step 2, the decoder 36 then cyclically reads the frame elements 22 of the sequence of frames 20 from bitstream 12. In doing so, the decoder 36 skips frame elements, or remaining/payload portions thereof, by use of the length information 58 as has been described above. In the third step, the decoder 36 performs the reconstruction by decoding the frame elements not having been skipped.

In deciding in step 2 which of the element positions and substreams are to be skipped, the decoder 36 may inspect the configuration elements 56 within the configuration block 28. In order to do so, the decoder 36 may be configured to cyclically read the configuration elements 56 from the configuration block 28 of bitstream 12 in the same order as used for the element type indicators 54 and the frame elements 22 themselves. As denoted above, the cyclic reading of the configuration elements 56 may be interleaved with the cyclic reading of the syntax elements 54. In particular, the decoder 36 may inspect the extension element type field 72 within the configuration elements 56 of extension element type substreams. If the extension element type is not a supported one, the decoder 36 skips the respective substream and the corresponding frame elements 22 at the respective frame element positions within frames 20.

In order to ease the bitrate needed for transmitting the length information 58, the decoder 36 is configured to inspect the configuration elements 56 of extension element type substreams, and in particular the default payload length information 60 thereof in step 1. In the second step, the decoder 36 inspects the length information 58 of extension frame elements 22 to be skipped. In particular, first, the decoder 36 inspects flag 64. If set, the decoder 36 uses the default length indicated for the respective substream by the default payload length information 60, as the remaining payload length to be skipped in order to proceed with the cyclical reading/parsing of the frame elements of the frames. If flag 64, however, is not set then the decoder 36 explicitly reads the payload length 66 from the bitstream 12. Although not explicitly explained above, it should be clear that the decoder 36 may derive the number of bits or bytes to be skipped in order to access the next frame element of the current frame or the next frame by some additional computation. For example, the decoder 36 may take into account whether the fragmentation mechanism is activated or not, as explained above with respect to flag 78. If activated, the decoder 36 may take into account that the frame elements of the substream having flag 78 set, in any case have the fragmentation information 80 and that, accordingly, the payload data 68 starts later as it would have in case of the fragmentation flag 78 not being set.

In decoding in step 3, the decoder acts as usual: that is, the individual substreams are subject to respective decoding mechanisms or decoding modules, as shown in FIG. 2, wherein some substreams may form side information with respect to other substreams as has been explained above with respect to specific examples of extension substreams.

Regarding other possible details regarding the decoders functionality, reference is made to the above discussion. For completeness only, it is noted that decoder 36 may also skip the further parsing of configuration elements 56 in step 1, namely for those element positions which are to be skipped because, for example, the extension element type indicated by field 72 does not fit to a supported set of extension element types. Then, the decoder 36 may use the configuration length information 76 in order to skip respective configuration elements in cyclically reading/parsing the configuration elements 56, i.e. in skipping a respective number of bits/bytes in order to access the next bitstream syntax element such as the type indicator 54 of the next element position.

Before proceeding with the above mentioned specific syntax embodiment, it should be noted that the present invention is not restricted to be implemented with unified speech and audio coding and its facets like switching core coding using a mixture or a switching between AAC like frequency domain coding and LP coding using parametric coding (ACELP) and transform coding (TCX). Rather, the above mentioned substreams may represent audio signals using any coding scheme. Moreover, while in the below outlined specific syntax embodiment assume that SBR is a coding option of the core codec used to represent audio signals using single channel and channel pair element type substreams, SBR may also be no option of the latter element types, but merely be usable using extension element types.

Figure 5A:
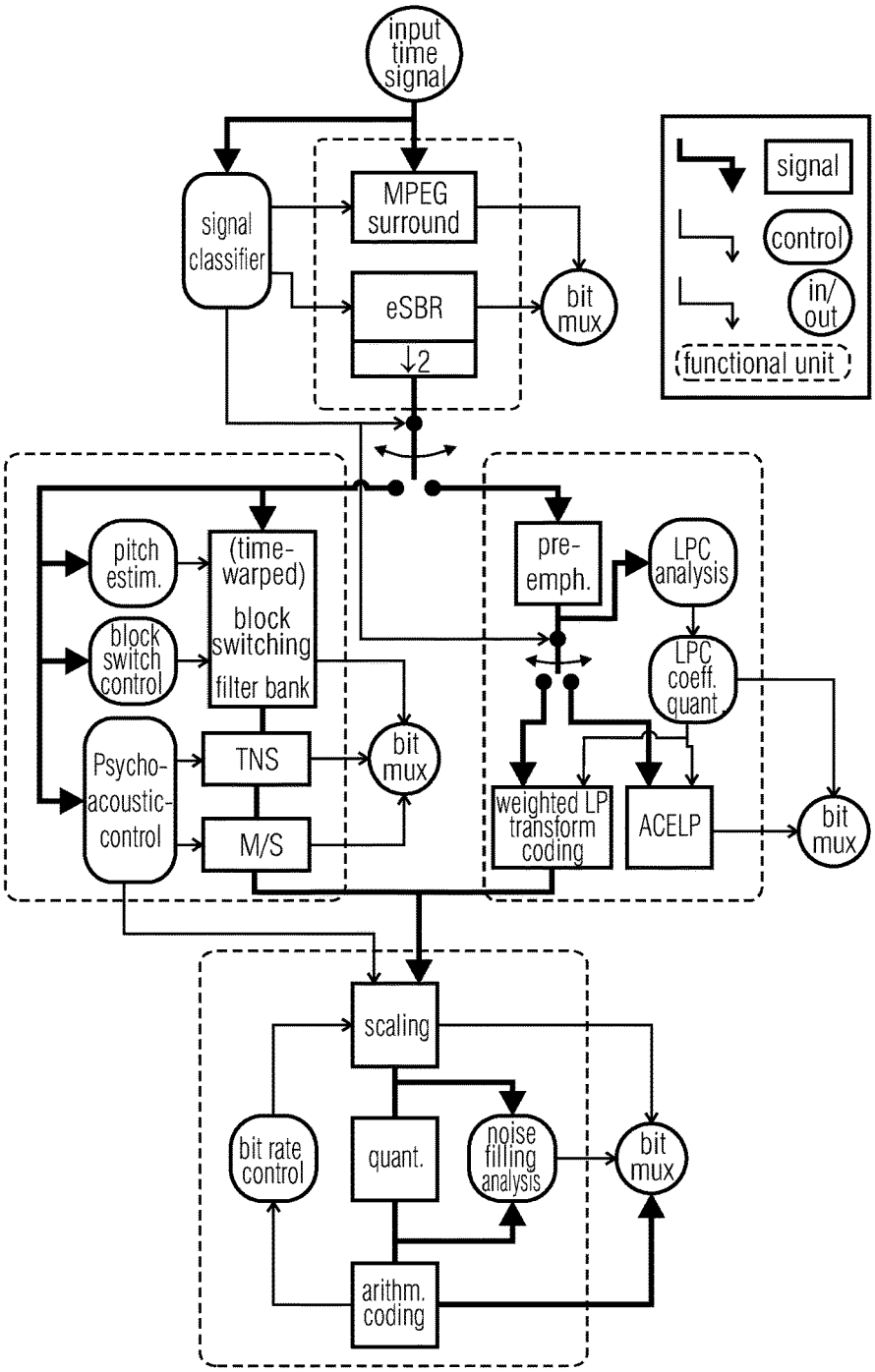
FIG 5A (PRIOR ART)
FIGS. 5 *a* and *b* show a block diagram of a USAC encoder and decoder.
Figure 5B:
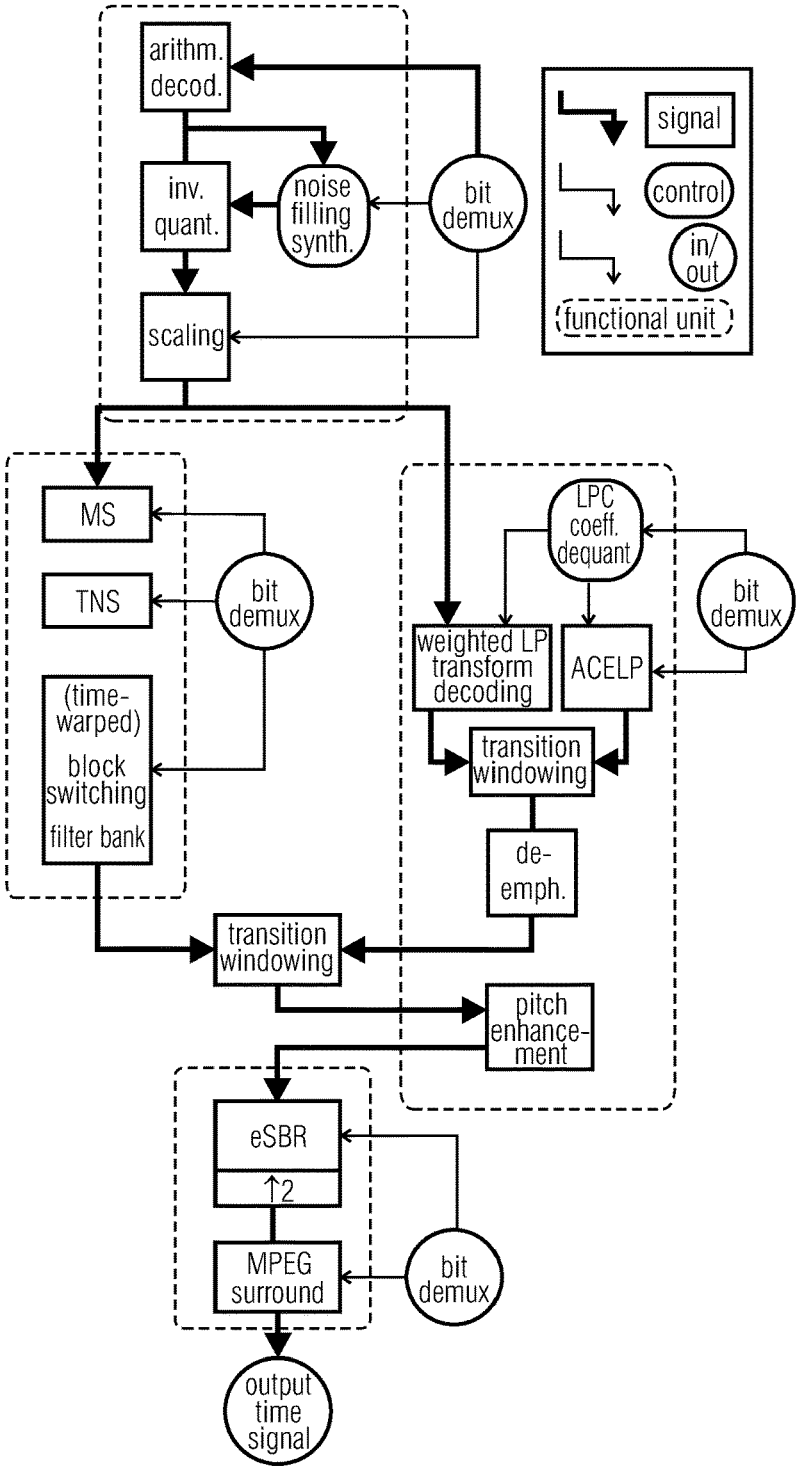
FIG 5B (PRIOR ART)
Figure 6:
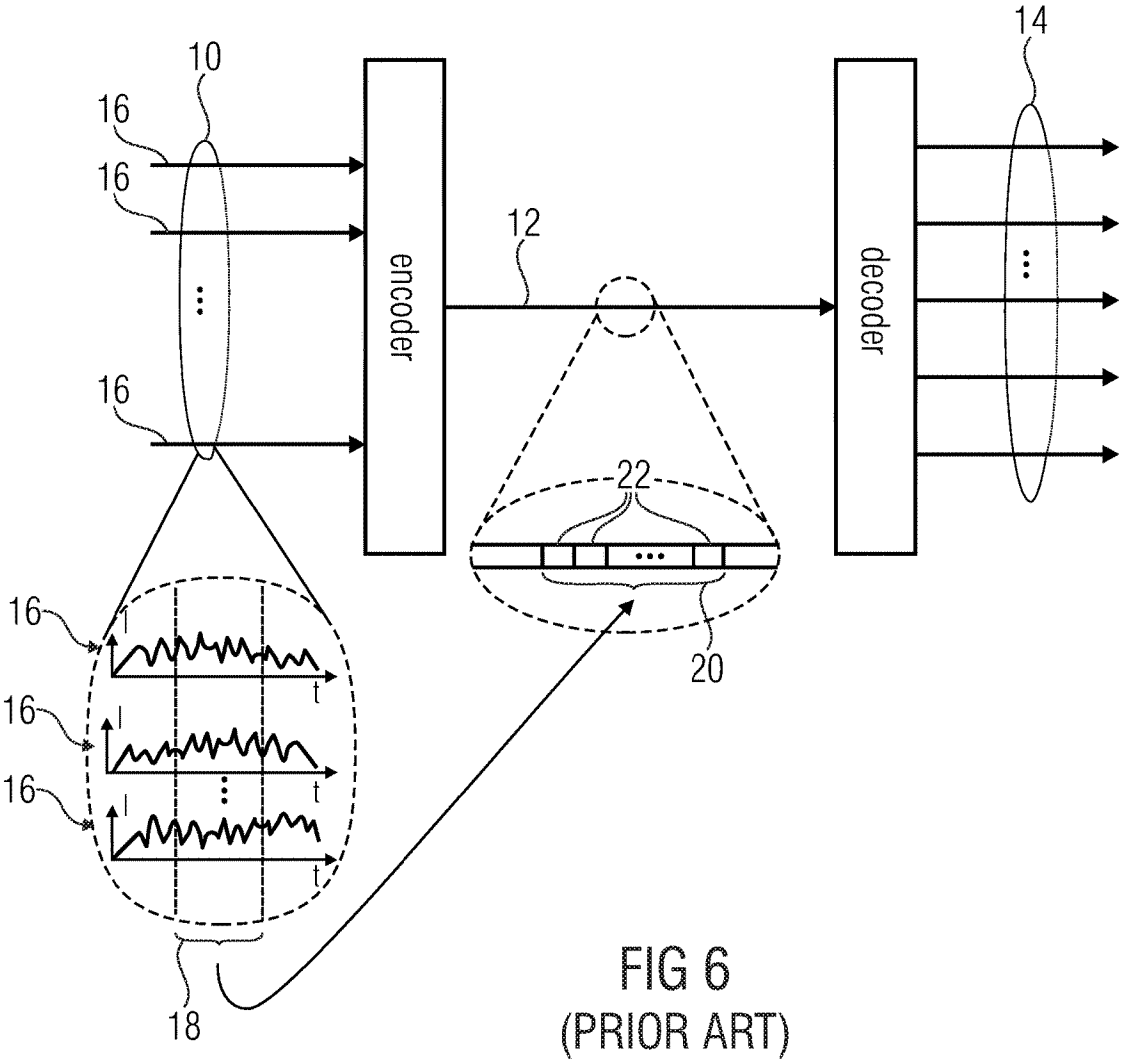
FIG 6 (PRIOR ART)
FIG. 6 shows a typical pair of encoder and decoder

In the following the specific syntax example for a bitstream 12 is explained. It should be noted that the specific syntax example represents a possible implementation for the embodiment of FIG. 3 and the concordance between the syntax elements of the following syntax and the structure of the bitstream of FIG. 3 is indicated or derivable from the respective notations in FIG. 3 and the description of FIG. 3. The basic aspects of the following specific example are outlined now. In this regard, it should be noted that any additional details in addition to those already described above with respect to FIG. 3 are to be understood as a possible extension of the embodiment of FIG. 3. All of these extensions may be individually built into the embodiment of FIG. 3. As a last preliminary note, it should be understood that the specific syntax example described below explicitly refers to the decoder and encoder environment of FIGS. 5*a* and 5*b*, respectively.

High level information, like sampling rate, exact channel configuration, about the contained audio content is present in the audio bitstream. This makes the bitstream more self contained and makes transport of the configuration and payload easier when embedded in transport schemes which may have no means to explicitly transmit this information.

The configuration structure contains a combined frame length and SBR sampling rate ratio index (coreSbrFrameLengthIndex)). This guarantees efficient transmission of both values and makes sure that non-meaningful combinations of frame length and SBR ratio cannot be signaled. The latter simplifies the implementation of a decoder.

The configuration can be extended by means of a dedicated configuration extension mechanism. This will prevent bulky and inefficient transmission of configuration extensions as known from the MPEG-4 AudioSpecificConfig( ).

Configuration allows free signaling of loudspeaker positions associated with each transmitted audio channel. Signaling of commonly used channel to loudspeaker mappings can be efficiently signaled by means of a channelConfigurationIndex.

Configuration of each channel element is contained in a separate structure such that each channel element can be configured independently.

SBR configuration data (the "SBR header") is split into an SbrInfo( ) and an SbrHeader( ). For the SbrHeader( ) a default version is defined (SbrDfltHeader( ), which can be efficiently referenced in the bitstream. This reduces the bit demand in places where re-transmission of SBR configuration data is needed.

More commonly applied configuration changes to SBR can be efficiently signaled with the help of the SbrInfo( ) syntax element.

The configuration for the parametric bandwidth extension (SBR) and the parametric stereo coding tools (MPS212, aka. MPEG Surround 2-1-2) is tightly integrated into the USAC configuration structure. This represents much better the way that both technologies are actually employed in the standard.

The syntax features an extension mechanism which allows transmission of existing and future extensions to the codec.

The extensions may be placed (i.e. interleaved) with the channel elements in any order. This allows for extensions which need to be read before or after a particular channel element which the extension shall be applied on.

A default length can be defined for a syntax extension, which makes transmission of constant length extensions very efficient, because the length of the extension payload does not need to be transmitted every time.

The common case of signaling a value with the help of an escape mechanism to extend the range of values if needed was modularized into a dedicated genuine syntax element (escapedValue( )) which is flexible enough to cover all desired escape value constellations and bit field extensions.

Bitstream Configuration

UsacConfig( ) (FIG. 4*a*)

The UsacConfig( ) was extended to contain information about the contained audio content as well as everything needed for the complete decoder set-up. The top level information about the audio (sampling rate, channel configuration, output frame length) is gathered at the beginning for easy access from higher (application) layers.

UsacChannelConfig( ) (FIG. 4*b*)

These elements give information about the contained bitstream elements and their mapping to loudspeakers. The channelConfigurationIndex allows for an easy and convenient way of signaling one out of a range of predefined mono, stereo or multi-channel configurations which were considered practically relevant.

For more elaborate configurations which are not covered by the channelConfigurationIndex the UsacChannel Config( ) allows for a free assignment of elements to loudspeaker position out of a list of 32 speaker positions, which cover all currently known speaker positions in all known speaker set-ups for home or cinema sound reproduction.

This list of speaker positions is a superset of the list featured in the MPEG Surround standard (see Table 1 and FIG. 1 in ISO/IEC 23003-1). Four additional speaker positions have been added to be able to cover the lately introduced 22.2 speaker set-up (see FIGS. 3*a*, 3*b*, 4*a* and 4*b*).

UsacDecoderConfig( ) (FIG. 4*c*)

This element is at the heart of the decoder configuration and as such it contains all further information that may be used by the decoder to interpret the bitstream.

In particular the structure of the bitstream is defined here by explicitly stating the number of elements and their order in the bitstream.

A loop over all elements then allows for configuration of all elements of all types (single, pair, lfe, extension).

UsacConfigExtension( ) (FIG. 4*l*)

In order to account for future extensions, the configuration features a powerful mechanism to extend the configuration for yet non-existent configuration extensions for USAC.

UsacSingleChannelElementConfig( ) (FIG. 4*d*)

This element configuration contains all information needed for configuring the decoder to decode one single channel. This is essentially the core coder related information and if SBR is used the SBR related information.

UsacChannelPairElementConfig( ) (FIG. 4*e*)

In analogy to the above this element configuration contains all information needed for configuring the decoder to decode one channel pair. In addition to the above mentioned core config and SBR configuration this includes stereo-specific configurations like the exact kind of stereo coding applied (with or without MPS212, residual etc.). Note that this element covers all kinds of stereo coding options available in USAC.

UsacLfeElementConfig( ) (FIG. 4*f*)

The LFE element configuration does not contain configuration data as an LFE element has a static configuration.

UsacExtElementConfig( ) (FIG. 4*k*)

This element configuration can be used for configuring any kind of existing or future extensions to the codec. Each extension element type has its own dedicated ID value. A length field is included in order to be able to conveniently skip over configuration extensions unknown to the decoder. The optional definition of a default payload length further increases the coding efficiency of extension payloads present in the actual bitstream.

Extensions which are already envisioned to be combined with USAC include: MPEG Surround, SAOC, and some sort of FIL element as known from MPEG-4 AAC.

UsacCoreConfig( ) (FIG. 4*g*)

This element contains configuration data that has impact on the core coder set-up. Currently these are switches for the time warping tool and the noise filling tool.

SbrConfig( ) (FIG. 4*h*)

In order to reduce the bit overhead produced by the frequent re-transmission of the sbr_header( ) default values for the elements of the sbr_header( ) that are typically kept constant are now carried in the configuration element SbrDfltHeader( ). Furthermore, static SBR configuration elements are also carried in SbrConfig( ). These static bits include flags for en- or disabling particular features of the enhanced SBR, like harmonic transposition or inter TES.

SbrDfltHeader( ) (FIG. 4*i*)

This carries elements of the sbr_header( ) that are typically kept constant. Elements affecting things like amplitude resolution, crossover band, spectrum preflattening are now carried in SbrInfo( ) which allows them to be efficiently changed on the fly.

Mps212Config( ) (FIG. 4*j*)

Similar to the above SBR configuration, all set-up parameters for the MPEG Surround 2-1-2 tools are assembled in this configuration. All elements from SpatialSpecificConfig( ) that are not relevant or redundant in this context were removed.

Bitstream Payload

UsacFrame( ) (FIG. 4*n*)

This is the outermost wrapper around the USAC bitstream payload and represents a USAC access unit. It contains a loop over all contained channel elements and extension elements as signaled in the config part. This makes the bitstream format much more flexible in terms of what it can contain and is future proof for any future extension.

UsacSingleChannelElement( ) (FIG. 4*o*)

This element contains all data to decode a mono stream. The content is split in a core coder related part and an eSBR related part. The latter is now much more closely connected to the core, which reflects also much better the order in which the data is needed by the decoder.

UsacChannelPairElement( ) (FIG. 4*p*)

This element covers the data for all possible ways to encode a stereo pair. In particular, all flavors of unified stereo coding are covered, ranging from legacy M/S based coding to fully parametric stereo coding with the help of MPEG Surround 2-1-2. stereoConfigIndex indicates which flavor is actually used. Appropriate eSBR data and MPEG Surround 2-1-2 data is sent in this element.

UsacLfeElement( ) (FIG. 4*q*)

The former lfe_channel_element( ) is renamed only in order to follow a consistent naming scheme.

UsacExtElement( ) (FIG. 4*r*)

The extension element was carefully designed to be able to be maximally flexible but at the same time maximally efficient even for extensions which have a small payload (or frequently none at all). The extension payload length is signaled for nescient decoders to skip over it. User-defined extensions can be signaled by means of a reserved range of extension types. Extensions can be placed freely in the order of elements. A range of extension elements has already been considered including a. mechanism to write fill bytes.

UsacCoreCoderData( ) (FIG. 4*s*)

This new element summarizes all information affecting the core coders and hence also contains fd_channel_stream( )'s and lpd_channel_stream( )'s.

StereoCoreToolInfo( ) (FIG. 4*t*)

In order to ease the readability of the syntax, all stereo related information was captured in this element. It deals with the numerous dependencies of bits in the stereo coding modes.

UsacSbrData( ) (FIG. 4*x*)

CRC functionality and legacy description elements of scalable audio coding were removed from what used to be the sbr_extension_data( ) element. In order to reduce the overhead caused by frequent re-transmission of SBR info and header data, the presence of these can be explicitly signaled.

SbrInfo( ) (FIG. 4*y*)

SBR configuration data that is frequently modified on the fly. This includes elements controlling things like amplitude resolution, crossover band, spectrum preflattening, which previously may have used the transmission of a complete sbr_header( ) (see 6.3 in [N11660], "Efficiency").

SbrHeader( ) (FIG. 4*z*)

In order to maintain the capability of SBR to change values in the sbr_header( ) on the fly, it is now possible to carry an SbrHeader( ) inside the UsacSbrData( ) in case other values than those sent in SbrDfltHeader( ) should be used. The bs_header_extra mechanism was maintained in order to keep overhead as low as possible for the most common cases.

sbr_data( ) (FIG. 4*za*)

Again, remnants of SBR scalable coding were removed because they are not applicable in the USAC context. Depending on the number of channels the sbr_data( ) contains one sbr_single_channel_element( ) or one sbr_channel_pair_element( ).

usacSamplingFrequencyIndex

This table is a superset of the table used in MPEG-4 to signal the sampling frequency of the audio codec. The table was further extended to also cover the sampling rates that are currently used in the USAC operating modes. Some multiples of the sampling frequencies were also added.

channelConfigurationIndex

This table is a superset of the table used in MPEG-4 to signal the channelConfiguration. It was further extended to allow signaling of commonly used and envisioned future loudspeaker setups. The index into this table is signaled with 5 bits to allow for future extensions.

usacElementType

Only 4 element types exist. One for each of the four basic bitstream elements: UsacSingleChannelElement( ), UsacChannelPairElement( ), UsacLfeElement( ), UsacExtElement( ). These elements provide the useful top level structure while maintaining all needed flexibility.

usacExtElementType

Inside of UsacExtElement( ), this element allows to signal a plethora of extensions. In order to be future proof the bit field was chosen large enough to allow for all conceivable extensions. Out of the currently known extensions already few are proposed to be considered: fill element, MPEG Surround, and SAOC.

usacConfigExtType

Should it at some point be useful to extend the configuration then this can be handled by means of the UsacConfigExtension( ) which would then allow to assign a type to each new configuration. Currently the only type which can be signaled is a fill mechanism for the configuration.

coreSbrFrameLengthIndex

This table shall signal multiple configuration aspects of the decoder. In particular these are the output frame length, the SBR ratio and the resulting core coder frame length (ccfl). At the same time it indicates the number of QMF analysis and synthesis bands used in SBR stereoConfigIndex This table determines the inner structure of a UsacChannelPairElement( ). It indicates the use of a mono or stereo core, use of MPS212, whether stereo SBR is applied, and whether residual coding is applied in MPS212.

By moving large parts of the eSBR header fields to a default header which can be referenced by means of a default header flag, the bit demand for sending eSBR control data was greatly reduced. Former sbr_header( ) bit fields that were considered to change most likely in a real world system were outsourced to the sbrInfo( ) element instead which now consists only of 4 elements covering a maximum of 8 bits. Compared to the sbr_header( ) which consists of at least 18 bits this is a saving of 10 bit.

It is more difficult to assess the impact of this change on the overall bitrate because it depends heavily on the rate of transmission of eSBR control data in sbrInfo( ). However, already for the common use case where the sbr crossover is altered in a bitstream the bit saving can be as high as 22 bits per occurrence when sending an sbrInfo( ) instead of a fully transmitted sbr_header( ).

The output of the USAC decoder can be further processed by MPEG Surround (MPS) (ISO/IEC 23003-1) or SAOC (ISO/IEC 23003-2). If the SBR tool in USAC is active, a USAC decoder can typically be efficiently combined with a subsequent MPS/SAOC decoder by connecting them in the QMF domain in the same way as it is described for HE-AAC in ISO/IEC 23003-1 4.4. If a connection in the QMF domain is not possible, they need to be connected in the time domain.

If MPS/SAOC side information is embedded into a USAC bitstream by means of the usacExtElement mechanism (with usacExtElementType being ID_EXT_ELE_MPEGS or ID_EXT_ELE_SAOC), the time-alignment between the USAC data and the MPS/SAOC data assumes the most efficient connection between the USAC decoder and the MPS/SAOC decoder. If the SBR tool in USAC is active and if MPS/SAOC employs a 64 band QMF domain representation (see ISO/IEC 23003-1 6.6.3), the most efficient connection is in the QMF domain. Otherwise, the most efficient connection is in the time domain. This corresponds to the time-alignment for the combination of HE-AAC and MPS as defined in ISO/IEC 23003-1 4.4, 4.5, and 7.2.1.

The additional delay introduced by adding MPS decoding after USAC decoding is given by ISO/IEC 23003-1 4.5 and depends on whether HQ MPS or LP MPS is used, and whether MPS is connected to USAC in the QMF domain or in the time domain.

ISO/IEC 23003-1 4.4 clarifies the interface between USAC and MPEG Systems. Every access unit delivered to the audio decoder from the systems interface shall result in a corresponding composition unit delivered from the audio decoder to the systems interface, i.e., the compositor. This shall include start-up and shut-down conditions, i.e., when the access unit is the first or the last in a finite sequence of access units.

For an audio composition unit, ISO/IEC 14496-1 7.1.3.5 Composition Time Stamp (CTS) specifies that the composition time applies to the n-th audio sample within the composition unit. For USAC, the value of n is 1. Note that this applies to the output of the USAC decoder itself. In the case that a USAC decoder is, for example, being combined with an MPS decoder needs to be taken into account for the composition units delivered at the output of the MPS decoder.

If MPS/SAOC side information is embedded into a USAC bitstream by means of the usacExtElement mechanism (with usacExtElementType being ID_EXT_ELE_MPEGS or ID_EXT_ELE_SAOC), the following restrictions may, optionally, apply:

- The MPS/SAOC sacTimeAlign parameter (see ISO/IEC 23003-1 7.2.5) shall have the value 0.
- The sampling frequency of MPS/SAOC shall be the same as the output sampling frequency of USAC.
- The MPS/SAOC bsFrameLength parameter (see ISO/IEC 23003-1 5.2) shall have one of the allowed values of a predetermined list.

The USAC bitstream payload syntax is shown in FIGS. 4*n* to 4*r*, and the syntax of subsidiary payload elements shown in FIG. 4*s-w*, and enhanced SBR payload syntax is shown in FIGS. 4*x* to 4*zc*.

Short Description of Data Elements

UsacConfig( ) This element contains information about the contained audio content as well as everything needed for the complete decoder set-up UsacChannelConfig( ) This element give information about the contained bitstream elements and their mapping to loudspeakers UsacDecoderConfig( ) This element contains all further information that may be used by the decoder to interpret the bitstream. In particular the SBR resampling ratio is signaled here and the structure of the bitstream is defined here by explicitly stating the number of elements and their order in the bitstream UsacConfigExtension( ) Configuration extension mechanism to extend the configuration for future configuration extensions for USAC.

UsacSingleChannelElementConfig( ) contains all information needed for configuring the decoder to decode one single channel. This is essentially the core coder related information and if SBR is used the SBR related information.

UsacChannelPairElementConfig( ) In analogy to the above this element configuration contains all information needed for configuring the decoder to decode one channel pair. In addition to the above mentioned core config and sbr configuration this includes stereo specific configurations like the exact kind of stereo coding applied (with or without MPS212, residual etc.). This element covers all kinds of stereo coding options currently available in USAC.

UsacLfeElementConfig( ) The LFE element configuration does not contain configuration data as an LFE element has a static configuration.

UsacExtElementConfig( ) This element configuration can be used for configuring any kind of existing or future extensions to the codec. Each extension element type has its own dedicated type value. A length field is included in order to be able to skip over configuration extensions unknown to the decoder.

UsacCoreConfig( ) contains configuration data which have impact on the core coder set-up.

SbrConfig( ) contains default values for the configuration elements of eSBR that are typically kept constant. Furthermore, static SBR configuration elements are also carried in SbrConfig( ). These static bits include flags for en- or disabling particular features of the enhanced SBR, like harmonic transposition or inter TES.

SbrDfltHeader( ) This element carries a default version of the elements of the SbrHeader( ) that can be referred to if no differing values for these elements are desired.

Mps212Config( ) All set-up parameters for the MPEG Surround 2-1-2 tools are assembled in this configuration.

escapedValue( ) this element implements a general method to transmit an integer value using a varying number of bits. It features a two level escape mechanism which allows to extend the representable range of values by successive transmission of additional bits.

usacSamplingFrequencyIndex This index determines the sampling frequency of the audio signal after decoding. The value of usacSamplingFrequencyIndex and their associated sampling frequencies are described in Table C.

TABLE C

Value and meaning of usacSamplingFrequencyIndex

| usacSamplingFrequencyIndex | sampling frequency |
|---|---|
| 0x00 | 96000 |
| 0x01 | 88200 |
| 0x02 | 64000 |
| 0x03 | 48000 |
| 0x04 | 44100 |

TABLE C-continued

Value and meaning of usacSamplingFrequencyIndex

| usacSamplingFrequencyIndex | sampling frequency |
|---|---|
| 0x05 | 32000 |
| 0x06 | 24000 |
| 0x07 | 22050 |
| 0x08 | 16000 |
| 0x09 | 12000 |
| 0x0a | 11025 |
| 0x0b | 8000 |
| 0x0c | 7350 |
| 0x0d | reserved |
| 0x0e | reserved |
| 0x0f | 57600 |
| 0x10 | 51200 |
| 0x11 | 40000 |
| 0x12 | 38400 |
| 0x13 | 34150 |
| 0x14 | 28800 |
| 0x15 | 25600 |
| 0x16 | 20000 |
| 0x17 | 19200 |
| 0x18 | 17075 |
| 0x19 | 14400 |
| 0x1a | 12800 |
| 0x1b | 9600 |
| 0x1c | reserved |
| 0x1d | reserved |
| 0x1e | reserved |
| 0x1f | escape value |

NOTE:
The values of UsacSamplingFrequencyIndex 0x00 up to 0x0e are identical to those of the samplingFrequencyIndex 0x0 up to 0xe contained in the AudioSpecificConfig( ) specified in ISO/IEC 14496-3:2009 usacSamplingFrequency Output sampling frequency of the decoder coded as unsigned integer value in case usacSamplingFrequencyIndex equals zero.

channelConfigurationIndex This index determines the channel configuration. If channelConfigurationIndex>0 the index unambiguously defines the number of channels, channel elements and associated loudspeaker mapping according to Table Y. The names of the loudspeaker positions, the used abbreviations and the general position of the available loudspeakers can be deduced from FIGS. 3*a*, 3*b* and FIGS. 4*a* and 4*b*.

bsOutputChannelPos This index describes loudspeaker positions which are associated to a given channel according to Table XX. Figure Y indicates the loudspeaker position in the 3D environment of the listener. In order to ease the understanding of loudspeaker positions Table XX also contains loudspeaker positions according to IEC 100/1706/CDV which are listed here for information to the interested reader.

TABLE

Values of coreCoderFrameLength, sbrRatio, outputFrameLength and numSlots depending on coreSbrFrameLengthIndex

| Index | coreCoder-FrameLength | sbrRatio (sbrRatioIndex) | output-FrameLength | Mps212 numSlots |
|---|---|---|---|---|
| 0 | 768 | no SBR (0) | 768 | N.A. |
| 1 | 1024 | no SBR (0) | 1024 | N.A. |
| 2 | 768 | 8:3 (2) | 2048 | 32 |
| 3 | 1024 | 2:1 (3) | 2048 | 32 |
| 4 | 1024 | 4:1 (1) | 4096 | 64 |
| 5-7 | | reserved | | |

usacConfigExtensionPresent Indicates the presence of extensions to the configuration numOutChannels If the value of channelConfigurationIndex indicates that none of the pre-defined channel configurations is used then this element determines the number of audio channels for which a specific loudspeaker position shall be associated.

numElements This field contains the number of elements that will follow in the loop over element types in the UsacDecoderConfig( )

usacElementType[elemIdx] defines the USAC channel element type of the element at position elemIdx in the bitstream. Four element types exist, one for each of the four basic bitstream elements: UsacSingleChannelElement( ), UsacChannelPairElement( ), UsacLfeElement( ), UsacExtElement( ). These elements provide the useful top level structure while maintaining all needed flexibility. The meaning of usacElementType is defined in Table A.

TABLE A

Value of usacElementType

| usacElementType | Value |
|---|---|
| ID_USAC_SCE | 0 |
| ID_USAC_CPE | 1 |
| ID_USAC_LFE | 2 |
| ID_USAC_EXT | 3 |

stereoConfigIndex This element determines the inner structure of a UsacChannelPairElement( ). It indicates the use of a mono or stereo core, use of MPS212, whether stereo SBR is applied, and whether residual coding is applied in MPS212 according to Table ZZ. This element also defines the values of the helper elements bsStereoSbr and bsResidualCoding.

TABLE ZZ

Values of stereoConfigIndex and its meaning and implicit assignment of bsStereoSbr and bsResidualCoding

| stereoConfigIndex | meaning | bsStereoSbr | bsResidualCoding |
|---|---|---|---|
| 0 | regular CPE (no MPS212) | N/A | 0 |
| 1 | single channel + MPS212 | N/A | 0 |
| 2 | two channels + MPS212 | 0 | 1 |
| 3 | two channels + MPS212 | 1 | 1 |

tw_mdct This flag signals the usage of the time-warped MDCT in this stream.

noiseFilling This flag signals the usage of the noise filling of spectral holes in the FD core coder.

harmonicSBR This flag signals the usage of the harmonic patching for the SBR.

bs_interTes This flag signals the usage of the inter-TES tool in SBR.

dflt_start_freq This is the default value for the bitstream element bs_start_freq, which is applied in case the flag sbrUseDfltHeader indicates that default values for the SbrHeader( ) elements shall be assumed.

dflt_stop_freq This is the default value for the bitstream element bs_stop_freq, which is applied in case the flag sbrUseDfltHeader indicates that default values for the SbrHeader( ) elements shall be assumed.

dflt_header_extra1 This is the default value for the bitstream element bs_header_extra1, which is applied in case the flag sbrUseDfltHeader indicates that default values for the SbrHeader( ) elements shall be assumed.

dflt_header_extra2 This is the default value for the bitstream element bs_header_extra2, which is applied in case the flag sbrUseDfltHeader indicates that default values for the SbrHeader( ) elements shall be assumed.

dflt_freq_scale This is the default value for the bitstream element bs_freq_scale, which is applied in case the flag sbrUseDfltHeader indicates that default values for the SbrHeader( ) elements shall be assumed.

dflt_alter_scale This is the default value for the bitstream element bs_alter_scale, which is applied in case the flag sbrUseDfltHeader indicates that default values for the SbrHeader( ) elements shall be assumed.

dflt_noise_bands This is the default value for the bitstream element bs_noise_bands, which is applied in case the flag sbrUseDfltHeader indicates that default values for the SbrHeader( ) elements shall be assumed.

dflt_limiter_bands This is the default value for the bitstream element bs_limiter_bands, which is applied in case the flag sbrUseDfltHeader indicates that default values for the SbrHeader( ) elements shall be assumed.

dflt_limiter_gains This is the default value for the bitstream element bs_limitergains, which is applied in case the flag sbrUseDfltHeader indicates that default values for the SbrHeader( ) elements shall be assumed.

dflt_interpol_freq This is the default value for the bitstream element bs_interpol_freq, which is applied in case the flag sbrUseDfltHeader indicates that default values for the SbrHeader( ) elements shall be assumed.

dflt_smoothing_mode This is the default value for the bitstream element bs_smoothing_mode, which is applied in case the flag sbrUseDfltHeader indicates that default values for the SbrHeader( ) elements shall be assumed.

usacExtElementType this element allows to signal bitstream extensions types. The meaning of usacExtElementType is defined in Table B.

TABLE B

Value of usacExtElementType

| usacExtElementType | Value |
|---|---|
| ID_EXT_ELE_FILL | 0 |
| ID_EXT_ELE_MPEGS | 1 |
| ID_EXT_ELE_SAOC | 2 |
| /* reserved for ISO use */ | 3-127 |
| /* reserved for use outside of ISO scope */ | 128 and higher |

NOTE:
Application-specific usacExtElementType values are mandated to be in the space reserved for use outside of ISO scope. These are skipped by a decoder as a minimum of structure may be used by the decoder to skip these extensions.

usacExtElementConfigLength signals the length of the extension configuration in bytes (octets).

usacExtElementDefaultLengthPresent This flag signals whether a usacExtElementDefaultLength is conveyed in the UsacExtElementConfig( ).

usacExtElementDefaultLength signals the default length of the extension element in bytes. Only if the extension element in a given access unit deviates from this value, an additional length needs to be transmitted in the bitstream. If this element is not explicitly transmitted (usacExtElement- DefaultLengthPresent==0) then the value of usacExtElementDefaultLength shall be set to zero.

usacExtElementPayloadFrag This flag indicates whether the payload of this extension element may be fragmented and send as several segments in consecutive USAC frames.

numConfigExtensions If extensions to the configuration are present in the UsacConfig( ) this value indicates the number of signaled configuration extensions.

confExtIdx Index to the configuration extensions.

usacConfigExtType This element allows to signal configuration extension types. The meaning of usacExtElementType is defined in Table D.

TABLE D

Value of usacConfigExtType

| usacConfigExtType | Value |
|---|---|
| ID_CONFIG_EXT_FILL | 0 |
| /* reserved for ISO use */ | 1-127 |
| /* reserved for use outside of ISO scope */ | 128 and higher |

usacConfigExtLength signals the length of the configuration extension in bytes (octets).

bsPseudoLr This flag signals that an inverse mid/side rotation should be applied to the core signal prior to Mps212 processing.

TABLE bsPseudoLr

| bsPseudoLr | Meaning |
|---|---|
| 0 | Core decoder output is DMX/RES |
| 1 | Core decoder output is Pseudo L/R |

bsStereoSbr This flag signals the usage of the stereo SBR in combination with MPEG Surround decoding.

TABLE bsStereoSbr

| bsStereoSbr | Meaning |
|---|---|
| 0 | Mono SBR |
| 1 | Stereo SBR |

bsResidualCoding indicates whether residual coding is applied according to the Table below. The value of bsResidualCoding is defined by stereoConfigIndex (see X).

TABLE X bsResidualCoding

| bsResidualCoding | Meaning |
|---|---|
| 0 | no residual coding, core coder is mono |
| 1 | residual coding, core coder is stereo |

sbrRatioIndex indicates the ratio between the core sampling rate and the sampling rate after eSBR processing. At the same time it indicates the number of QMF analysis and synthesis bands used in SBR according to the Table below.

TABLE

Definition of sbrRatioIndex

| sbrRatioIndex | sbrRatio | QMF band ratio (analysis:synthesis) |
|---|---|---|
| 0 | no SBR | — |
| 1 | 4:1 | 16:64 |
| 2 | 8:3 | 24:64 |
| 3 | 2:1 | 32:64 |

elemIdx Index to the elements present in the UsacDecoderConfig( ) and the UsacFrame( ).

UsacConfig( )

The UsacConfig( ) contains information about output sampling frequency and channel configuration. This information shall be identical to the information signaled outside of this element, e.g. in an MPEG-4 AudioSpecificConfig( ).

Usac Output Sampling Frequency

If the sampling rate is not one of the rates listed in the right column in Table 1, the sampling frequency dependent tables (code tables, scale factor band tables etc.) are deduced in order for the bitstream payload to be parsed. Since a given sampling frequency is associated with only one sampling frequency table, and since maximum flexibility is desired in the range of possible sampling frequencies, the following table shall be used to associate an implied sampling frequency with the desired sampling frequency dependent tables.

TABLE 1

Sampling frequency mapping

| Frequency range (in Hz) | Use tables for sampling frequency (in Hz) |
|---|---|
| f >=92017 | 96000 |
| 92017 > f >= 75132 | 88200 |
| 75132 > f >= 55426 | 64000 |
| 55426 > f >= 46009 | 48000 |
| 46009 > f >= 37566 | 44100 |
| 37566 > f >= 27713 | 32000 |
| 27713 > f >= 23004 | 24000 |
| 23004 > f >= 18783 | 22050 |
| 18783 > f >= 13856 | 16000 |
| 13856 > f >= 11502 | 12000 |
| 11502 > f >= 9391 | 11025 |
| 9391 > f | 8000 |

UsacChannelConfig ( )

The channel configuration table covers most common loudspeaker positions. For further flexibility channels can be mapped to an overall selection of 32 loudspeaker positions found in modern loudspeaker setups in various applications (see FIGS. 3*a*, 3*b*)

For each channel contained in the bitstream the UsacChannelConfig( ) specifies the associated loudspeaker position to which this particular channel shall be mapped. The loudspeaker positions which are indexed by bsOutputChannelPos are listed in Table X. In case of multiple channel elements the index i of bsOutputChannelPos[i] indicates the position in which the channel appears in the bitstream. Figure Y gives an overview over the loudspeaker positions in relation to the listener.

More precisely the channels are numbered in the sequence in which they appear in the bitstream starting with 0 (zero). In the trivial case of a UsacSingleChannelElement( ) or UsacLfeElement( ) the channel number is assigned to that channel and the channel count is increased by one. In case of a UsacChannelPairElement( ) the first channel in that element (with index ch==0) is numbered first, whereas the second channel in that same element (with index ch==1) receives the next higher number and the channel count is increased by two.

It follows that numOutChannels shall be equal to or smaller than the accumulated sum of all channels contained in the bitstream. The accumulated sum of all channels is equivalent to the number of all UsacSingleChannel Element( )'s plus the number of all UsacLfeElement( )'s plus two times the number of all UsacChannelPair Element( )'s.

All entries in the array bsOutputChannelPos shall be mutually distinct in order to avoid double assignment of loudspeaker positions in the bitstream.

In the special case that channelConfigurationIndex is 0 and numOutChannels is smaller than the accumulated sum of all channels contained in the bitstream, then the handling of the non-assigned channels is outside of the scope of this specification. Information about this can e.g. be conveyed by appropriate means in higher application layers or by specifically designed (private) extension payloads.

UsacDecoderConfig( )

The UsacDecoderConfig( ) contains all further information that may be used by the decoder to interpret the bitstream. Firstly the value of sbrRatioIndex determines the ratio between core coder frame length (ccfl) and the output frame length. Following the sbrRatioIndex is a loop over all channel elements in the present bitstream. For each iteration the type of element is signaled in usacElementType[ ], immediately followed by its corresponding configuration structure. The order in which the various elements are present in the UsacDecoderConfig( ) shall be identical to the order of the corresponding payload in the UsacFrame( ).

Each instance of an element can be configured independently. When reading each channel element in Usac Frame( ), for each element the corresponding configuration of that instance, i.e. with the same elemIdx, shall be used.

UsacSingleChannelElementConfig( )

The UsacSingleChannelElementConfig( ) contains all information needed for configuring the decoder to decode one single channel. SBR configuration data is only transmitted if SBR is actually employed.

UsacChannelPairElementConfig( )

The UsacChannelPairElementConfig( ) contains core coder related configuration data as well as SBR configuration data depending on the use of SBR. The exact type of stereo coding algorithm is indicated by the stereoConfigIndex. In USAC a channel pair can be encoded in various ways. These are:

1. Stereo core coder pair using traditional joint stereo coding techniques, extended by the possibility of complex prediction in the MDCT domain
2. Mono core coder channel in combination with MPEG Surround based MPS212 for fully parametric stereo coding. Mono SBR processing is applied on the core signal.
3. Stereo core coder pair in combination with MPEG Surround based MPS212, where the first core coder channel carries a downmix signal and the second channel carries a residual signal. The residual may be band limited to realize partial residual coding. Mono SBR processing is applied only on the downmix signal before MPS212 processing.
4. Stereo core coder pair in combination with MPEG Surround based MPS212, where the first core coder channel carries a downmix signal and the second channel carries a residual signal. The residual may be band limited to realize partial residual coding. Stereo SBR is applied on the reconstructed stereo signal after MPS212 processing.

Option 3 and 4 can be further combined with a pseudo LR channel rotation after the core decoder.

UsacLfeElementConfig( )

Since the use of the time warped MDCT and noise filling is not allowed for LFE channels, there is no need to transmit the usual core coder flag for these tools. They shall be set to zero instead.

Also the use of SBR is not allowed nor meaningful in an LFE context. Thus, SBR configuration data is not transmitted.

UsacCoreConfig( )

The UsacCoreConfig( ) only contains flags to en- or disable the use of the time warped MDCT and spectral noise filling on a global bitstream level. If tw_mdct is set to zero, time warping shall not be applied. If noiseFilling is set to zero the spectral noise filling shall not be applied.

SbrConfig( )

The SbrConfig( ) bitstream element serves the purpose of signaling the exact eSBR setup parameters. On one hand the SbrConfig( ) signals the general employment of eSBR tools. On the other hand it contains a default version of the SbrHeader( ), the SbrDfltHeader( ). The values of this default header shall be assumed if no differing SbrHeader( ) is transmitted in the bitstream. The background of this mechanism is, that typically only one set of SbrHeader( ) values are applied in one bitstream. The transmission of the SbrDfltHeader( ) then allows to refer to this default set of values very efficiently by using only one bit in the bitstream. The possibility to vary the values of the SbrHeader on the fly is still retained by allowing the in-band transmission of a new SbrHeader in the bitstream itself.

SbrDfltHeader( )

The SbrDfltHeader( ) is what may be called the basic SbrHeader( ) template and should contain the values for the predominantly used eSBR configuration. In the bitstream this configuration can be referred to by setting the sbrUseDfltHeader flag. The structure of the SbrDfltHeader( ) is identical to that of SbrHeader( ). In order to be able to distinguish between the values of the SbrDfltHeader( ) and SbrHeader( ), the bit fields in the SbrDfltHeader( ) are prefixed with "dflt_" instead of "bs_". If the use of the SbrDfltHeader( ) is indicated, then the SbrHeader( ) bit fields shall assume the values of the corresponding SbrDflt Header( ), i.e.

```
bs_start_freq = dflt_start_freq;
bs_stop_freq = dflt_stop_freq;
etc.
(continue for all elements in SbrHeader( ), like:
bs_xxx_yyy = dflt_xxx_yyy;
```

Mps212Config( )

The Mps212Config( ) resembles the SpatialSpecificConfig( ) of MPEG Surround and was in large parts deduced from that. It is however reduced in extent to contain only information relevant for mono to stereo upmixing in the USAC context. Consequently MPS212 configures only one OTT box.

UsacExtElementConfig( )

The UsacExtElementConfig( ) is a general container for configuration data of extension elements for USAC. Each USAC extension has a unique type identifier, usacExtElementType, which is defined in Table X. For each UsacExtElementConfig( ) the length of the contained extension configuration is transmitted in the variable usacExtElementConfigLength and allows decoders to safely skip over extension elements whose usacExtElementType is unknown.

For USAC extensions which typically have a constant payload length, the UsacExtElementConfig( ) allows the transmission of a usacExtElementDefaultLength. Defining a default payload length in the configuration allows a highly efficient signaling of the usacExtElementPayloadLength inside the UsacExtElement( ), where bit consumption needs to be kept low.

In case of USAC extensions where a larger amount of data is accumulated and transmitted not on a per frame basis but only every second frame or even more rarely, this data may be transmitted in fragments or segments spread over several USAC frames. This can be helpful in order to keep the bit reservoir more equalized. The use of this mechanism is signaled by the flag usacExtElementPayloadFrag flag. The fragmentation mechanism is further explained in the description of the usacExtElement in 6.2.X.

UsacConfigExtension( )

The UsacConfigExtension( ) is a general container for extensions of the UsacConfig( ). It provides a convenient way to amend or extend the information exchanged at the time of the decoder initialization or set-up. The presence of config extensions is indicated by usacConfigExtensionPresent. If config extensions are present (usacConfigExtensionPresent==1), the exact number of these extensions follows in the bit field numConfigExtensions. Each configuration extension has a unique type identifier, usacConfigExtType, which is defined in Table X. For each UsacConfigExtension the length of the contained configuration extension is transmitted in the variable usacConfigExtLength and allows the configuration bitstream parser to safely skip over configuration extensions whose usacConfigExtType is unknown.

Top Level Payloads for the Audio Object Type USAC

Terms and Definitions

UsacFrame( ) This block of data contains audio data for a time period of one USAC frame, related information and other data. As signaled in UsacDecoderConfig( ), the UsacFrame( ) contains numElements elements. These elements can contain audio data, for one or two channels, audio data for low frequency enhancement or extension payload.

UsacSingleChannelElement( ) Abbreviation SCE. Syntactic element of the bitstream containing coded data for a single audio channel. A single_channel_element( ) basically consists of the UsacCoreCoderData( ), containing data for either FD or LPD core coder. In case SBR is active, the UsacSingleChannelElement also contains SBR data.

UsacChannelPairElement( ) Abbreviation CPE. Syntactic element of the bitstream payload containing data for a pair of channels. The channel pair can be achieved either by transmitting two discrete channels or by one discrete channel and related Mps212 payload. This is signaled by means of the stereoConfigIndex. The UsacChannelPairElement further contains SBR data in case SBR is active.

UsacLfeElement( ) Abbreviation LFE. Syntactic element that contains a low sampling frequency enhancement channel LFEs are encoded using the fd_channel_stream( ) element.

UsacExtElement( ) Syntactic element that contains extension payload. The length of an extension element is either signaled as a default length in the configuration (USACExtElementConfig( ) or signaled in the UsacExtElement( ) itself. If present, the extension payload is of type usacExtElementType, as signaled in the configuration.

usacIndependencyFlag indicates if the current UsacFrame( ) can be decoded entirely without the knowledge of information from previous frames according to the Table below

TABLE

Meaning of usacIndependencyFlag

| value of usacIndependencyFlag | Meaning |
|---|---|
| 0 | Decoding of data conveyed in UsacFrame( ) might use access to the previous UsacFrame( ). |
| 1 | Decoding of data conveyed in UsacFrame( ) is possible without access to the previous UsacFrame( ). |

NOTE:
Please refer to X.Y for recommendations on the use of the usacIndependencyFlag.

usacExtElementUseDefaultLength indicates whether the length of the extension element corresponds to usacExtElementDefaultLength, which was defined in the UsacExtElementConfig( ).

usacExtElementPayloadLength shall contain the length of the extension element in bytes. This value should only be explicitly transmitted in the bitstream if the length of the extension element in the present access unit deviates from the default value, usacExtElementDefaultLength.

usacExtElementStart Indicates if the present usacExtElementSegmentData begins a data block.

usacExtElementStop Indicates if the present usacExtElementSegmentData ends a data block.

usacExtElementSegmentData The concatenation of all usacExtElementSegmentData from UsacExtElement( ) of consecutive USAC frames, starting from the UsacExtElement( ) with usacExtElementStart==1 up to and including the UsacExtElement( ) with usacExtElementStop==1 forms one data block. In case a complete data block is contained in one UsacExtElement( ) usacExtElementStart and usacExtElementStop shall both be set to 1. The data blocks are interpreted as a byte aligned extension payload depending on usacExtElementType according to the following Table:

TABLE

Interpretation of data blocks for USAC extension payload decoding

| usacExtElementType | The concatenated usacExtElementSegmentData represents: |
|---|---|
| ID_EXT_ELE_FIL | Series of fill_byte |
| ID_EXT_ELE_MPEGS | SpatialFrame( ) |
| ID_EXT_ELE_SAOC | SaocFrame( ) |
| unknown | unknown data. The data block shall be discarded. |

fill_byte Octet of bits which may be used to pad the bitstream with bits that carry no information. The exact bit pattern used for fill_byte should be '10100101'.

Helper Elements nrCoreCoderChannels In the context of a channel pair element this variable indicates the number of core coder channels which form the basis for stereo coding. Depending on the value of stereoConfigIndex this value shall be 1 or 2.

nrSbrChannels In the context of a channel pair element this variable indicates the number of channels on which SBR processing is applied. Depending on the value of stereoConfigIndex this value shall be 1 or 2.

Subsidiary Payloads for USAC

Terms and Definitions

UsacCoreCoderData( ) This block of data contains the core-coder audio data. The payload element contains data for one or two core-coder channels, for either FD or LPD mode. The specific mode is signaled per channel at the beginning of the element.

StereoCoreToolInfo( ) All stereo related information is captured in this element. It deals with the numerous dependencies of bits fields in the stereo coding modes.

Helper Elements commonCoreMode in a CPE this flag indicates if both encoded core coder channels use the same mode.

Mps212Data( ) This block of data contains payload for the Mps212 stereo module. The presence of this data is dependent on the stereoConfigIndex.

common_window indicates if channel 0 and channel 1 of a CPE use identical window parameters.

common_tw indicates if channel 0 and channel 1 of a CPE use identical parameters for the time warped MDCT.

Decoding of UsacFrame( )

One UsacFrame( ) forms one access unit of the USAC bitstream. Each UsacFrame decodes into 768, 1024, 2048 or 4096 output samples according to the output-FrameLength determined from Table X.

The first bit in the UsacFrame( ) is the usacIndependencyFlag, which determines if a given frame can be decoded without any knowledge of the previous frame. If the usacIndependencyFlag is set to 0, then dependencies to the previous frame may be present in the payload of the current frame.

The UsacFrame( ) is further made up of one or more syntactic elements which shall appear in the bitstream in the same order as their corresponding configuration elements in the UsacDecoderConfig( ). The position of each element in the series of all elements is indexed by elemIdx. For each element the corresponding configuration, as transmitted in the UsacDecoderConfig( ), of that instance, i.e. with the same elemIdx, shall be used.

These syntactic elements are of one of four types, which are listed in Table X. The type of each of these elements is determined by usacElementType. There may be multiple elements of the same type. Elements occurring at the same position elemIdx in different frames shall belong to the same stream.

TABLE

Examples of simple possible bitstream payloads

| | numElements | elemIdx | usacElementType[elemIdx] |
|---|---|---|---|
| mono output signal | 1 | 0 | ID_USAC_SCE |
| stereo output signal | 1 | 0 | ID_USAC_CPE |
| 5.1 channel output signal | 4 | 0 | ID_USAC_SCE |
| | | 1 | ID_USAC_CPE |
| | | 2 | ID_USAC_CPE |
| | | 3 | ID_USAC_LFE |

If these bitstream payloads are to be transmitted over a constant rate channel then they might include an extension payload element with an usacExtElementType of ID_EXT_ELE_FILL to adjust the instantaneous bitrate. In this case an example of a coded stereo signal is:

TABLE

Examples of simple stereo bitstream with extension payload for writing fill bits.

| | numElements | elemIdx | usacElementType[elemIdx] |
|---|---|---|---|
| stereo output signal | 2 | 0 | ID_USAC_CPE |
| | | 1 | ID_USAC_EXT with usacExtElementType== ID_EXT_ELE_FILL |

Decoding of UsacSingleChannelElement( )

The simple structure of the UsacSingleChannelElement( ) is made up of one instance of a UsacCoreCoderData( ) element with nrCoreCoderChannels set to 1. Depending on the sbrRatioIndex of this element a UsacSbrData( ) element follows with nrSbrChannels set to 1 as well.

Decoding of UsacExtElement( )

UsacExtElement( ) structures in a bitstream can be decoded or skipped by a USAC decoder. Every extension is identified by a usacExtElementType, conveyed in the UsacExtElement( )'s associated UsacExtElementConfig( ). For each usacExtElementType a specific decoder can be present.

If a decoder for the extension is available to the USAC decoder then the payload of the extension is forwarded to the extension decoder immediately after the UsacExtElement( ) has been parsed by the USAC decoder.

If no decoder for the extension is available to the USAC decoder, a minimum of structure is provided within the bitstream, so that the extension can be ignored by the USAC decoder.

The length of an extension element is either specified by a default length in octets, which can be signaled within the corresponding UsacExtElementConfig( ) and which can be overruled in the UsacExtElement( ), or by an explicitly provided length information in the UsacExtElement( ), which is either one or three octets long, using the syntactic element escapedValue( ).

Extension payloads that span one or more UsacFrame( )'s can be fragmented and their payload be distributed among several UsacFrame( )'s. In this case the usacExtElementPayloadFrag flag is set to 1 and a decoder collects all fragments from the UsacFrame( ) with usacExtElementStart set to 1 up to and including the UsacFrame( ) with usacExtElementStop set to 1. When usacExtElementStop is set to 1 then the extension is considered to be complete and is passed to the extension decoder.

Note that integrity protection for a fragmented extension payload is not provided by this specification and other means should be used to ensure completeness of extension payloads. Note, that all extension payload data is assumed to be byte-aligned.

Each UsacExtElement( ) shall obey the requirements resulting from the use of the usacIndependencyFlag. Put more explicitly, if the usacIndependencyFlag is set (==1) the UsacExtElement( ) shall be decodable without knowledge of the previous frame (and the extension payload that may be contained in it).

Decoding Process

The stereoConfigIndex, which is transmitted in the UsacChannelPairElementConfig( ), determines the exact type of stereo coding which is applied in the given CPE. Depending on this type of stereo coding either one or two core coder channels are actually transmitted in the bitstream and the variable nrCoreCoderChannels needs to be set accordingly. The syntax element UsacCoreCoderData( ) then provides the data for one or two core coder channels.

Similarly the there may be data available for one or two channels depending on the type of stereo coding and the use of eSBR (ie. if sbrRatioIndex>0). The value of nrSbrChannels needs to be set accordingly and the syntax element UsacSbrData( ) provides the eSBR data for one or two channels.

Finally Mps212Data( ) is transmitted depending on the value of stereoConfigIndex.

Low Frequency Enhancement (LFE) Channel Element, UsacLfeElement( )

General

In order to maintain a regular structure in the decoder, the UsacLfeElement( ) is defined as a standard fd_channel_stream(0,0,0,0,x) element, i.e. it is equal to a UsacCoreCoderData( ) using the frequency domain coder. Thus, decoding can be done using the standard procedure for decoding a UsacCoreCoderData( ) element.

In order to accommodate a more bitrate and hardware efficient implementation of the LFE decoder, however, several restrictions apply to the options used for the encoding of this element:

- The window_sequence field is set to 0 (ONLY_LONG_SEQUENCE)
- Only the lowest 24 spectral coefficients of any LFE may be non-zero
- No Temporal Noise Shaping is used, i.e. tns_data_present is set to 0
- Time warping is not active
- No noise filling is applied UsacCoreCoderData( )

The UsacCoreCoderData( ) contains all information for decoding one or two core coder channels.

The order of decoding is:

- get the core_mode[ ] for each channel
- in case of two core coded channels (nrChannels==2), parse the StereoCoreToolInfo( ) and determine all stereo related parameters
- Depending on the signaled core_modes transmit an lpd_channel_stream( ) or an fd_channel_stream( ) for each channel As can be seen from the above list, the decoding of one core coder channel (nrChannels==1) results in obtaining the core_mode bit followed by one lpd_channel_stream or fd_channel_stream, depending on the core_mode.

In the two core coder channel case, some signaling redundancies between channels can be exploited in particular if the core_mode of both channels is 0. See 6.2.X (Decoding of StereoCoreToolInfo( ) for details StereoCoreToolInfo( )

The StereoCoreToolInfo( ) allows to efficiently code parameters, whose values may be shared across core coder channels of a CPE in case both channels are coded in FD mode (core_mode[0,1]==0). In particular the following data elements are shared, when the appropriate flag in the bitstream is set to 1.

TABLE

Bitstream elements shared across channels of a core coder channel pair

| common_xxx flag is set to 1 | channels 0 and 1 share the following elements: |
|---|---|
| common_window | ics_info( ) |
| common_window && common_max_sfb | max_sfb |
| common_tw | tw_data( ) |
| common_tns | tns_data( ) |

If the appropriate flag is not set then the data elements are transmitted individually for each core coder channel either in StereoCoreToolInfo( ) (max_sfb, max_sfb1) or in the fd_channel_stream( ) which follows the StereoCoreToolInfo( ) in the UsacCoreCoderData( ) element.

In case of common_window==1 the StereoCoreTool Info( ) also contains the information about M/S stereo coding and complex prediction data in the MDCT domain (see 7.7.2).

UsacSbrData( ) This block of data contains payload for the SBR bandwidth extension for one or two channels. The presence of this data is dependent on the sbrRatioIndex.

SbrInfo( ) This element contains SBR control parameters which may not use a decoder reset when changed.

SbrHeader( ) This element contains SBR header data with SBR configuration parameters, that typically do not change over the duration of a bitstream.

SBR Payload for USAC

In USAC the SBR payload is transmitted in UsacSbr Data( ), which is an integral part of each single channel element or channel pair element. UsacSbrData( ) follows immediately UsacCoreCoderData( ). There is no SBR payload for LFE channels.

numSlots The number of time slots in an Mps212Data frame.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

The encoded audio signal can be transmitted via a wireline or wireless transmission medium or can be stored on a machine readable carrier or on a non-transitory storage medium.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A decoder for decoding a bitstream, comprising an electronic circuit and a computer;

wherein the bitstream comprises a configuration block and a sequence of frames respectively representing consecutive time periods of an audio content, wherein the configuration block comprises a field indicating a number N of frame elements per frame, and a type indication syntax portion indicating, for each element position of a sequence of N element positions, an element type out of a plurality of element types, and wherein each of the sequence of frames comprises a sequence of N frame elements, the decoder is configured to decode each frame by decoding each frame element in accordance with the element type indicated, by the type indication syntax portion, so that the ith frame element of the sequence of N frame elements, is decoded in accordance with the element type indicated by the type indication syntax portion for the ith element position, wherein the plurality of element types comprises an extension element type, wherein the decoder is configured to read, from each frame element of the extension element type of any frame, a length information on a length of the respective frame element, skip at least a portion of at least some of the frame elements of the extension element type of the frames using the length information on the length of the respective frame element as skip interval length;

wherein the decoder is configured to read, for each element position for which the type indication syntax portion indicates the extension element type, a configuration element comprising configuration information for the extension element type from the configuration block, with, in reading the configuration information for the extension element type, reading default payload length information on a default extension payload length from the bitstream, the decoder is also configured to, in reading the length information of the frame elements of the extension element type, read a default extension payload length flag of a conditional syntax portion from the bitstream, check as to whether the default payload length flag is set, and, if the default payload length flag is not set, read an extension payload length value of the conditional syntax portion from the bitstream so as to obtain an extension payload length of the respective frame element, and, if the default payload length flag is set, set the extension payload length of the respective frame element to be equal to the default extension payload length, the decoder is also configured to skip a payload section of at least some of the frame elements of the extension element type of the frames using the extension payload length of the respective frame element as skip interval length, wherein the decoder is configured to, in reading the default payload length information, read a default payload length present flag from the bitstream, check as to whether the default payload length present flag is set, if the default payload length present flag is not set, set the default extension payload length to be zero, if the default payload length present flag is set, explicitly read the default extension payload length from the bit stream, and wherein the decoder is configured to reconstruct the audio content.

2. The decoder according to claim 1, wherein the decoder is configured to read a sequence of N syntax elements from the type indication syntax portion, with each element indicating the element type for the respective element position at which the respective syntax element is positioned in the sequence of N syntax elements.

3. The decoder according to claim 1, wherein the decoder is configured to read a sequence of N configuration elements from the configuration block, with each configuration element comprising configuration information so that the $i^{th}$ configuration element comprises configuration information on the element type for the $i^{th}$ element position, wherein the decoder is configured to, in decoding the $i^{th}$ frame element of the sequence of N frame elements, use the configuration information on the element type for the $i^{th}$ element position.

4. The decoder according to claim 3, wherein the type indication syntax portion comprises a sequence of N syntax elements, with each syntax element indicating the element type for the respective element position at which the respective syntax element is positioned in the sequence of N syntax elements, and the decoder is configured to read the configuration elements and the syntax elements from the bitstream alternately.

5. The decoder according to claim 1, wherein the decoder is configured to, in reading the length information of any frame element of the extension element type of the frames, read an extension payload present flag from the bitstream, check as to whether the extension payload present flag is set, and, if the extension payload present flag is not set, cease reading the respective frame element of the extension element type and proceed with reading another frame element of a current frame or a frame element of a subsequent frame, and if the extension payload present flag is set, read a syntax portion indicating an extension payload length of the respective frame of the extension element type from the bitstream, and skip, at least for some of the frame elements of the extension element type of the frames the extension payload present flag of the length information of which is set, a payload section thereof by using the extension payload length of the respective frame element of the extension element type read from the bitstream as skip interval length.

6. The decoder according to claim 1, wherein the decoder is configured to, in reading the configuration block, for each element position for which the type indication syntax portion indicates the extension element type, read a configuration element comprising configuration information for the extension element type from the bitstream, wherein the configuration information comprises an fragmentation use flag, and the decoder is configured to, in reading frame elements positioned at any element position for which the type indication syntax portion indicates the extension element type, and for which the fragmentation use flag of the configuration element is set, read a fragment information from the bitstream, and use the fragment information to put payload data of these frame elements of consecutive frames together.

7. The decoder according to claim 1, wherein the decoder is configured such that the decoder, in decoding frame elements in the frames at element positions for which the type indication syntax portion indicates a channel pair element type, reconstruct two audio signals.

8. A decoder for decoding a bitstream, comprising an electronic circuit and a computer;

wherein the bitstream comprises a configuration block and a sequence of frames respectively representing consecutive time periods of an audio content, wherein the configuration block comprises a field indicating a number N of frame elements per frame, and a type indication syntax portion indicating, for each element position of a sequence of N element positions, an element type out of a plurality of element types, and wherein each of the sequence of frames comprises a sequence of N frame elements, the decoder is configured to decode each frame by decoding each frame element in accordance with the element type indicated, by the type indication syntax portion, so that the ith frame element of the sequence of N frame elements, is decoded in accordance with the element type indicated by the type indication syntax portion for the ith element position, wherein the plurality of element types comprises an extension element type, wherein the decoder is configured to read, from each frame element of the extension element type of any frame, a length information on a length of the respective frame element, skip at least a portion of at least some of the frame elements of the extension element type of the frames using the length information on the length of the respective frame element as skip interval length, wherein the decoder is further configured to, in reading the configuration block, for each element position for which the type indication syntax portion indicates the extension element type, read a configuration element comprising configuration information for the extension element type from the bitstream, wherein the configuration information comprises an extension element type field indicating a payload data type out of a plurality of payload data types, wherein the plurality of payload data types comprises a multi-channel side information type and a multi-object coding side information type, the decoder is configured to, in reading the configuration block, for each element position for which the type indication syntax portion indicates the extension element type, if the extension element type field indicates the multi-channel side information type, read multi-channel side information configuration data as part of the configuration information from the bitstream, and if the extension element type field indicates the multiobject coding side information type, read multi-object side information configuration data as part of the configuration information from the bitstream, and the decoder is configured to, in decoding each frame, decode the frame elements of the extension element type positioned at any element position for which the type indication syntax portion indicates the extension element type, and for which the extension element type of the configuration element indicates the multi-channel side information type, by configuring a multi-channel decoder using the multi-channel side information configuration data and feeding the thus configured multi-channel decoder with payload data of the respective frame elements of the extension element type as multi-channel side information, decode the frame elements of the extension element type positioned at any element position for which the type indication syntax portion indicates the extension element type, and for which the extension element type of the configuration element indicates the multi-object coding side information type, by configuring a multi-object decoder using the multi-object side information configuration data and feeding the thus configured multi-object decoder with payload data of the respective frame elements of the extension element type as multi-object side information, and wherein the decoder is configured to reconstruct the audio content.

9. A method for decoding a bitstream, wherein the bitstream comprises a configuration block and a sequence of frames respectively representing consecutive time periods of an audio content, wherein the configuration block comprises a field indicating a number of elements N, and a type indication syntax portion indicating, for each element position of a sequence of N element positions, an element type out of a plurality of element types, and wherein each of the sequence of frames comprises a sequence of N frame elements, wherein the method comprises decoding each frame by decoding each frame element in accordance with the element type indicated, by the type indication syntax portion, for the respective element position at which the respective frame element is positioned within the sequence of N frame elements of the respective frame in the bitstream, wherein the plurality of element types comprises an extension element type, wherein the method further comprises reading, from each frame element of the extension element type of any frame, a length information on a length of the respective frame element, skipping at least a portion of at least some of the frame elements of the extension element type of the frames using the length information on the length of the respective frame element as skip interval length, wherein the decoder is further configured to, in reading the configuration block, for each element position for which the type indication syntax portion indicates the extension element type, read a configuration element comprising configuration information for the extension element type from the bitstream, wherein the configuration information comprises an extension element type field indicating a payload data type out of a plurality of payload data types, wherein the plurality of payload data types comprises a multi-channel side information type and a multi-object coding side information type, the reading the configuration block comprises, for each element position for which the type indication syntax portion indicates the extension element type, if the extension element type field indicates the multi-channel side information type, reading multi-channel side information configuration data as part of the configuration information from the bitstream, and if the extension element type field indicates the multiobject coding side information type, reading multi-object side information configuration data as part of the configuration information from the bitstream, and the method comprises, in decoding each frame, decoding the frame elements of the extension element type positioned at any element position for which the type indication syntax portion indicates the extension element type, and for which the extension element type of the configuration element indicates the multi-channel side information type, by configuring a multi-channel decoder using the multi-channel side information configuration data and feeding the thus configured multi-channel decoder with payload data of the respective frame elements of the extension element type as multi-channel side information, decoding the frame elements of the extension element type positioned at any element position for which the type indication syntax portion indicates the extension element type, and for which the extension element type of the configuration element indicates the multi-object coding side information type, by configuring a multi-object decoder using the multi-object side information configuration data and feeding the thus configured multi-object decoder with payload data of the respective frame elements of the extension element type as multi-object side information; and decoding the frames by reconstructing the audio content.

10. A non-transitory computer-readable medium having stored thereon a computer program for performing, when running on a computer, the method of claim 9.

* * * * *